US011564426B2

(12) United States Patent
Melching, Jr.

(10) Patent No.: US 11,564,426 B2
(45) Date of Patent: Jan. 31, 2023

(54) FACIAL COVERING SYSTEM

(71) Applicant: JMDM HOLDINGS LLC, New Hope, PA (US)

(72) Inventor: John Melching, Jr., New Hope, PA (US)

(73) Assignee: JMDM HOLDINGS LLC, New Hope, PA (US)

( * ) Notice: Subject to any disclaimer, the term of this patent is extended or adjusted under 35 U.S.C. 154(b) by 0 days.

(21) Appl. No.: 17/349,465

(22) Filed: Jun. 16, 2021

(65) Prior Publication Data

US 2022/0039494 A1 Feb. 10, 2022

Related U.S. Application Data

(60) Provisional application No. 63/157,341, filed on Mar. 5, 2021, provisional application No. 63/040,852, filed on Jun. 18, 2020.

(51) Int. Cl.
*A41D 13/11* (2006.01)

(52) U.S. Cl.
CPC ..... *A41D 13/1161* (2013.01); *A41D 13/113* (2013.01)

(58) Field of Classification Search
CPC .. A41D 13/11–1192; A62B 17/00–006; A62B 18/00; A62B 18/02; A62B 18/08; A62B 18/084–088; A62B 23/00–025; A61M 16/06–0622; A61M 2016/0661; A61M 16/0683
See application file for complete search history.

(56) References Cited

U.S. PATENT DOCUMENTS

| | | | | |
|---|---|---|---|---|
| 7,086,400 | B2 | 8/2006 | Shigematsu et al. | |
| 9,027,554 | B2 | 5/2015 | Lee et al. | |
| 9,079,051 | B2 | 7/2015 | Woo | |
| 10,561,181 | B2 | 2/2020 | Pearson | |
| 2008/0092897 | A1* | 4/2008 | Behm | A41D 13/11 128/206.12 |
| 2012/0234319 | A1* | 9/2012 | Eifler | A44B 11/266 128/202.27 |
| 2014/0069433 | A1* | 3/2014 | Walker | A61M 16/0057 128/206.21 |
| 2016/0029716 | A1* | 2/2016 | Duncan | A41D 13/11 128/863 |
| 2018/0007982 | A1* | 1/2018 | Reese | A41H 42/00 |
| 2019/0090558 | A1* | 3/2019 | Xu | A41D 13/1176 |

(Continued)

FOREIGN PATENT DOCUMENTS

| | | |
|---|---|---|
| JP | 2013252339 | 12/2013 |
| KR | 1020180121659 | 11/2018 |

(Continued)

*Primary Examiner* — Rachel T Sippel
(74) *Attorney, Agent, or Firm* — Gearhart Law LLC

(57) ABSTRACT

Described herein is a facemask and/or facial covering support system for a variety of masks and/or other facial coverings. The system is designed to redirect the straps and/or bands of a facial covering or facemask to prevent impinging on, or causing pain, to the ears of the user of the facial covering as well as preventing the facemask from obstructing the mouth/nose of the user. The system may be used with a dedicated facemask or retrofit onto existing facemasks. The system further allows for the facemask to be loosened without being completely removed.

12 Claims, 21 Drawing Sheets

(56) References Cited

U.S. PATENT DOCUMENTS

| | | | | |
|---|---|---|---|---|
| 2019/0358473 | A1 | 11/2019 | Szasz et al. | |
| 2021/0368885 | A1* | 12/2021 | Atri | A41D 13/1184 |
| 2021/0401084 | A1* | 12/2021 | Lamoncha | A41D 13/1161 |

FOREIGN PATENT DOCUMENTS

| | | |
|---|---|---|
| WO | 2016047579 | 3/2016 |
| WO | 2018210319 | 11/2018 |

* cited by examiner

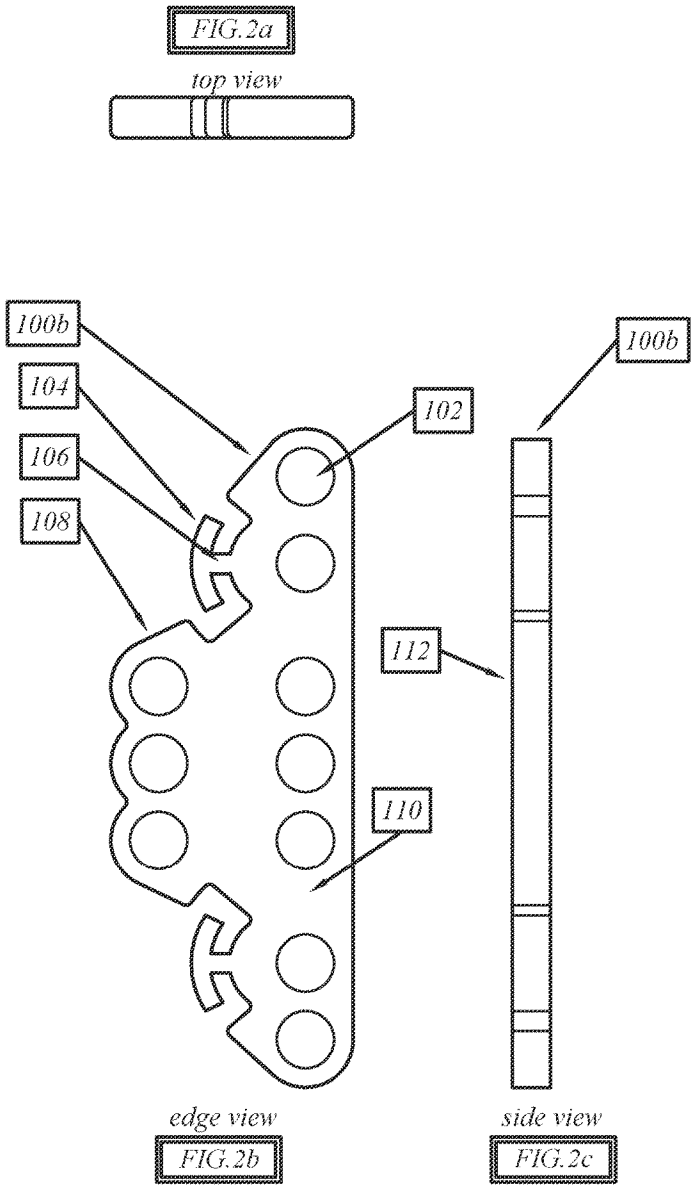
FIG.2a
top view
100b
102
104
106
108
110
112
edge view
FIG.2b
side view
FIG.2c
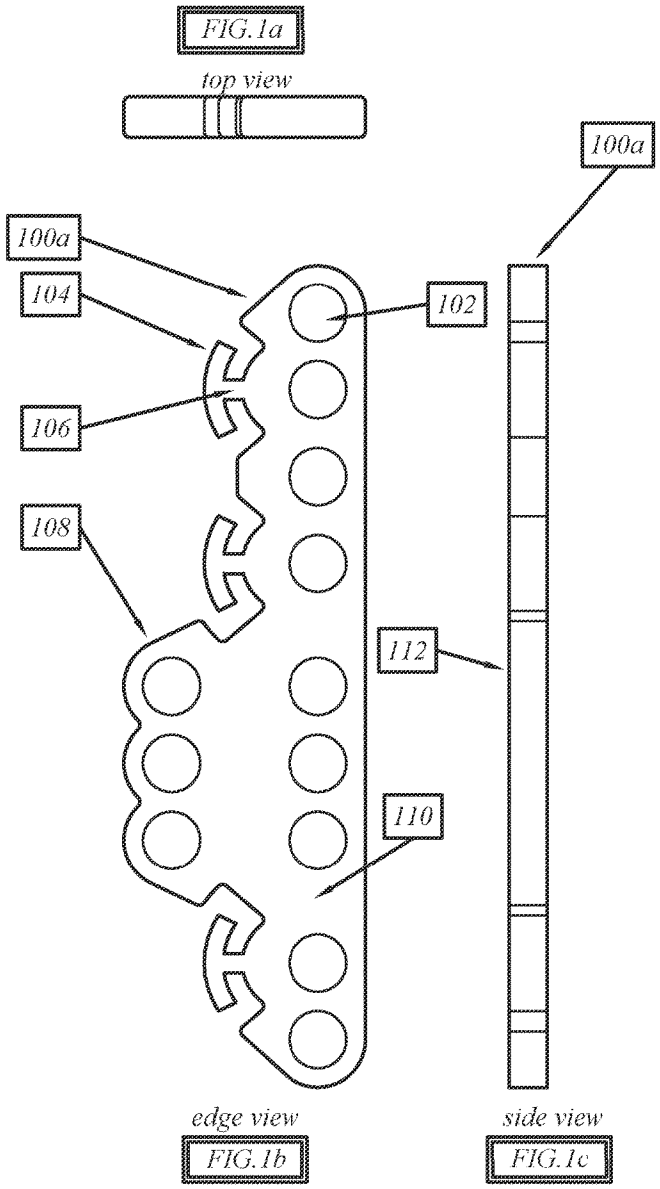
FIG.1a
top view
100a
102
104
106
108
110
112
edge view
FIG.1b
side view
FIG.1c

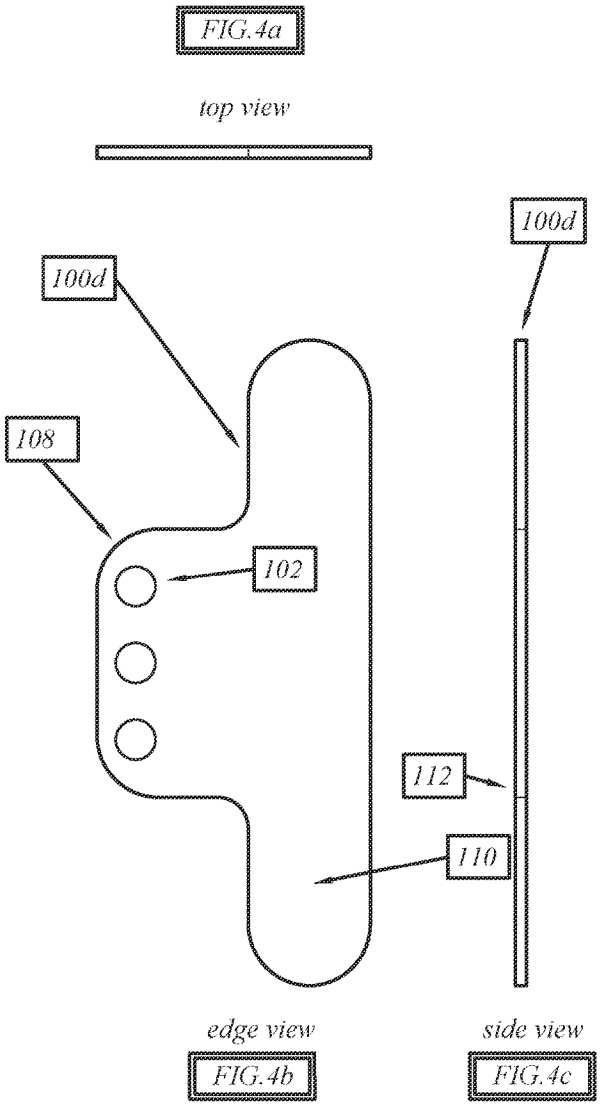
FIG.4a
top view
100d
100d
108
102
112
110
edge view
FIG.4b
side view
FIG.4c
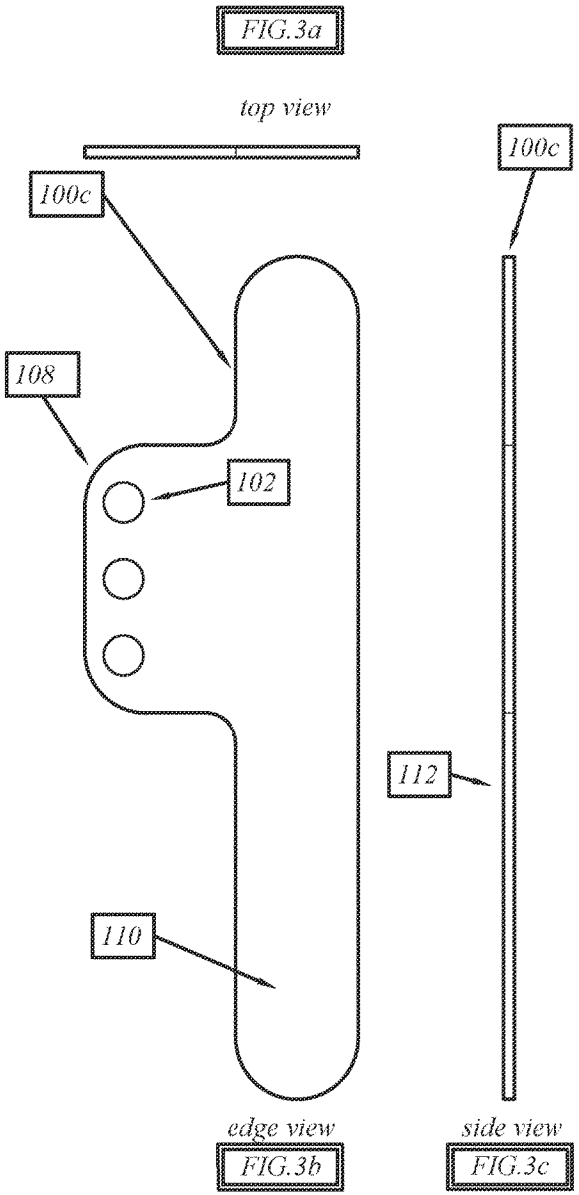
FIG.3a
top view
100c
100c
108
102
112
110
edge view
FIG.3b
side view
FIG.3c

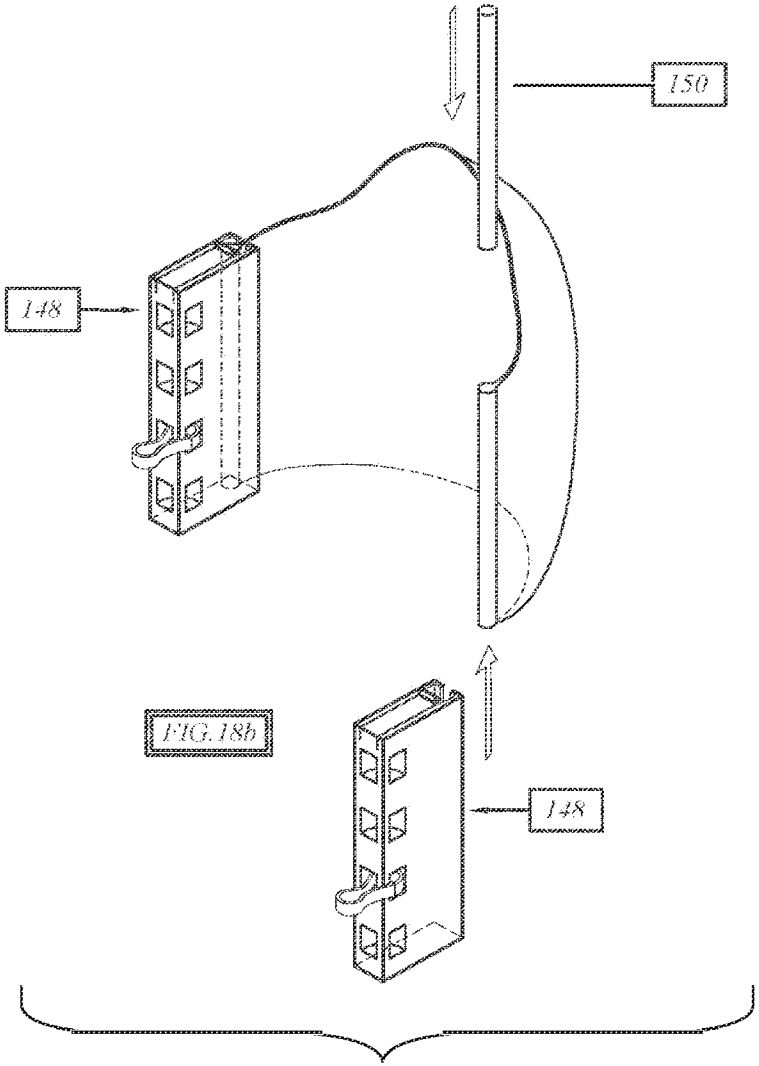
FIG. 18b
FIG. 18g
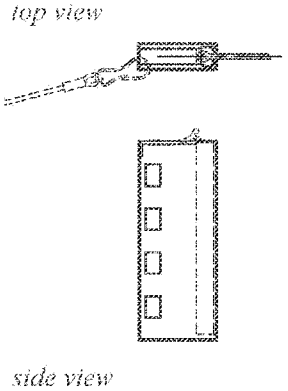
FIG. 18e
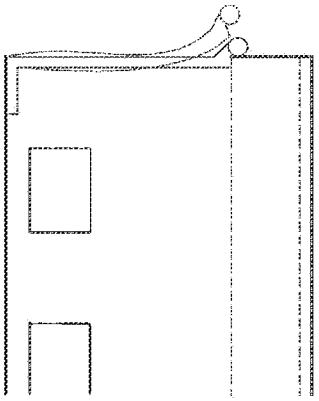
FIG. 18f

DETAIL A

DETAIL B

FACIAL COVERING SYSTEM

CLAIM OF PRIORITY

This application claims priority to U.S. Application 63/040,852 filed on Jun. 18, 2020, and U.S. Application 63/157,341 filed on Mar. 5, 2021, the contents of both of which are herein fully incorporated by reference in its entirety.

FIELD OF THE EMBODIMENTS

The field of the invention and its embodiments relate to a facemask and/or facial covering support system for a variety of masks and/or other facial coverings. In particular, the field of the invention and its embodiments relate to a system that redirects the straps and/or bands of a facial covering to prevent impinging on, or causing pain, to the ears of the user of the facial covering as well as preventing the mask from obstructing the mouth/nose of the user.

BACKGROUND OF THE EMBODIMENTS

Wearing a mask is one of the most effective protection measures against bacteria, viruses, airborne pathogens, dust, and the like. A conventional mask comprises a mask body and two loop-shaped elastic straps mounted on two opposite ends of the mask body. When in use, the straps are put on and around a user's ears, and the mask body is placed over the user's mouth and nose to isolate harmful substances, such as dust, bacteria, and the like, from the user's mouth and nose to prevent the harmful substances from touching and entering the user's mouth and nose.

However, each of the straps has a fixed size so that the size of each of the straps cannot be adjusted to fit that of different users, and the mask body cannot be placed on the user's mouth and nose exactly and closely, thereby decreasing the sealing effect of the mask. The straps will also impinge on a user's ears causing discomfort after wearing for only a short period of time. In addition, the mask body has a poor breathability and poor permeability so that when the user wears the mask body, the user cannot breathe smoothly, thereby easily causing an uncomfortable sensation to the user. Thus, there is a need for a mask that meets and exceeds such shortcomings. The present invention and its embodiments meet and exceed these objectives.

Review of Related Technology:

WO2018/210319 pertains to a strap fixing device, comprising: a fixing base comprising a body; a rotating frame comprising a support pivotally connected to the body and a fixed hanging part provided on the pivot end of the support, wherein the rotating frame may be rotated or fixed relative to the fixing base; and a distance adjustment mechanism disposed on the support and provided with a movable hanging part. The movable hanging portion may be linearly displaced along the length direction of the support and positioned to adjust the distance between the movable hanging portion and the fixed hanging portion. In this way, the present invention makes it more comfortable to wear a breathing mask, with no pressure on the ears and the head, thereby achieving zero loads.

WO2016/047579 pertains to a hygienic mask which is capable of being worn without putting a burden on an ear. The hygienic mask comprises a mask main body part formed from a flexible material which covers at least from the tip of a wearer's nose to the end of the wearer's chin, and a mask wearing part which couples the right edge part and the left edge part of the mask main body part. The mask wearing part further comprises a pair of support parts which are respectively fixed to the left and right lateral edge parts of the mask main body part, and a rear wearing part which passes below both of the wearer's ears and encircles behind the wearer's neck part. A right support part is configured from a pair of right support members which respectively connect two right anchor locations which differ vertically in locations on the mask main body part to one right coupling location further forward than the wearer's right ear at which the rear wearing part is coupled. A left support part is configured from a pair of left support members which respectively connect two left anchor locations which differ vertically in locations on the mask main body part to one left coupling location further forward than the wearer's left ear at which the rear wearing part is coupled.

KR1020180121659 pertains to a mask provided with a latch that can maintain a latched state of fastening cords and suppress offsetting when the mask is worn. A latch of a mask is in the form of an oblong thin sheet and includes a first latching part for disengageably latching one fastening cord of the mask and a second latching part positioned on the second end edge side of the first latching part, having an insertion through hole for inserting the other fastening cord of the mask in advance. The first latching part has a guide channel extending from the first lateral edge and a first latching hole connected to the guide channel, and the second latching part has a second latching hole communicating with the insertion through hole, and having an outer shape smaller than that, and the first latching hole and the second latching hole are directed in directions opposed to one another in a lateral direction.

JP2013252339 pertains to a fastening implement for a mask, eliminating the pain of ears by strings of the mask, in particular, in long-time use. Described is a fastening implement for a mask that includes, on both sides of a body, at least two fastening parts allowing the fastening of strings of the mask which is equipped with the strings capable of being hung on the ears of a user by elastic members such as rubber strings. Thereby, loads are not imposed on the ears, so that the pain of the ears do not occur.

Thus, as noted above, various systems and methodologies of hygienic masks are known in the art. However, their structure and means of operation are substantially different from the present disclosure. The other inventions fail to solve all the problems taught by the present disclosure. At least one embodiment of this invention is presented in the drawings below and will be described in more detail herein.

SUMMARY OF THE EMBODIMENTS

The present invention and its embodiments teach and describe a facial covering system that includes at least a bracket, mask skeleton, and a mask body. This facial covering system removes the need for the elastic band to be supported by an ear of the wearer. Instead, the back of the neck area is utilized by the lanyard attached to the bracket and the elastic band is attached to the bracket as well. In yet other embodiments, the elastic band may be completely removed and rely on the facial covering system solely to support the position of the mask body.

Generally, the embodiments of the present invention may comprise any of the following components: a bracket, a tab element, a fastening strap, a mask body, a mask skeleton, and a securement mechanism. In some embodiments, the bracket is connected directly to a mask or facial covering to allow the bracket to be attached directly to the mask or facial covering. In other embodiments, the bracket is coupled to an edge of the mask body or the mask body itself.

In at least one embodiment, there is a fastening strap or lanyard attached to the bracket that replaces the need to put elastic banding of the existing facial covering around the head or ear of the user. Instead, the elastic banding is connected to a portion of the bracket. In yet another embodiment, the elastic banding is woven through the bracket and then a portion of the elastic banding is used to be connected to a lanyard. In yet another embodiment, support elements such as the aforementioned tabs are used as an interface between the fastening strap or lanyard and the bracket. Each of the above-described elements may be used singularly or in conjunction with one another in any combination.

The bracket preferably has several attachments positions allowing various configurations for existing masks and/or facial coverings. The positioning and orientation of said structures allows for the arrangements described herein. As shown in the drawings and further described herein, there may be different configurations of these structures to support a particular need or use case. Further, this facial covering system allows for the facial coverings to be selectively loosened and otherwise manipulated without completely removing the facial covering. Not only does the system prevent interference with an ear of the user, but also prevents interferences with hearing aids, glasses, and the like or some combination thereof.

In a first embodiment of the present invention there a facial covering system having a first bracket with a plurality of first apertures and a second bracket with a plurality of second apertures; a mask body comprising at least one layer of a textile, the mask body further having a first edge and a second edge with the first bracket coupled to the first edge and the second bracket coupled to the second edge; a mask skeleton coupled to the mask body, wherein the mask skeleton is coupled to the at least one layer of textile; and a fastening strap having a first end and a second end, the first end of the fastening strap being configured to couple to the first bracket and the second end of the fastening strap being configured to couple to the second bracket.

In another embodiment of the present invention there is a facial covering system having a first bracket with a plurality of first apertures and a second bracket with a plurality of second apertures; a mask body comprising at least one layer of a textile, the mask body further having a first edge and a second edge with the first bracket coupled to the first edge and the second bracket coupled to the second edge; a mask skeleton coupled to the mask body, wherein the mask skeleton is coupled to the at least one layer of textile; a fastening strap having a first end and a second end, the first end of the fastening strap being configured to couple to the first bracket and the second end of the fastening strap being configured to couple to the second bracket, wherein the first end and the second end each have two attachment points configured to couple to the mask skeleton.

In yet another embodiment of the present invention there is a facial covering system having a first bracket with a plurality of first apertures and at least one first hook and a second bracket with a plurality of second apertures and at least one second hook; a mask body comprising at least one layer of a textile, the mask body further having a first edge and a second edge with the first bracket coupled to the first edge and the second bracket coupled to the second edge, wherein the mask body has a sealing strip disposed along a top edge of the mask body; a mask skeleton coupled to the mask body, the mask skeleton having a plurality of apertures, wherein the mask skeleton is coupled to the at least one layer of textile of the mask body; a fastening strap having a first end and a second end, the first end of the fastening strap being configured to couple to the first bracket and the second end of the fastening strap being configured to couple to the second bracket. It is an object of the present invention to provide a facial covering system that can be used with virtually any mask.

It is an object of the present invention to provide a facial covering system that is lightweight and easy to use.

It is an object of the present invention to provide a facial covering system that redirects or removes the strap of the mask thereby preventing the strap from impinging on the user, particularly the user's ears.

It is an object of the present invention to provide a facial covering system that prevents or limits fogging of glasses.

It is an object of the present invention to provide a facial covering system that may be used in a number of varying configurations depending on user preference and the mask utilized within the system.

It is an object of the present invention to provide a facial covering system that positions the mask body in such a way as to not obstruct the mouth and/or nose of the user.

It is an object of the present invention to provide a facial covering system that allows for a mask to be loosened without fully being removed.

It is an object of the present invention to provide a facial covering system that is comfortable to wear for extended durations while protecting the user from dust, pathogens, and the like.

It is an object of the present invention to provide a facial covering system that may be retrofit onto existing masks.

BRIEF DESCRIPTION OF THE DRAWINGS

FIG. 1*a* is a top view of a first mask bracket of an embodiment of the present application.

FIG. 1*b* is a side view of a first mask bracket of an embodiment of the present application.

FIG. 1*c* is a front view of a first mask bracket of an embodiment of the present application.

FIG. 2*a* is a top view of a second mask bracket of an embodiment of the present application.

FIG. 2*b* is a side view of a second mask bracket of an embodiment of the present application.

FIG. 2*c* is a front view of a second mask bracket of an embodiment of the present application.

FIG. 3*a* is a top view of a third mask bracket of an embodiment of the present application.

FIG. 3*b* is a side view of a third mask bracket of an embodiment of the present application.

FIG. 3*c* is a front view of a third mask bracket of an embodiment of the present application.

FIG. 4*a* is a top view of a fourth mask bracket of an embodiment of the present application.

FIG. 4*b* is a side view of a fourth mask bracket of an embodiment of the present application.

FIG. 4*c* is a front view of a fourth mask bracket of an embodiment of the present application.

FIG. 18*b* illustrates a second alternate mask bracket in accordance with the present application.

FIG. 18*c* illustrates a first alternate mask bracket as shown in FIG. 18*a*.

FIG. 18*e* illustrates a view of the second alternate mask bracket as shown in FIG. 18*b*.

FIG. 18*f* illustrates a close-up view of the second alternate mask bracket shown in FIG. 18*b*.

FIG. 18*g* illustrates a top view of the alternate mask bracket shown in FIG. 18*e*.

FIG. 18*h* illustrates a top view of the alternate mask bracket shown in FIG. 18*k*.

FIG. 18*i* illustrates a top view of the "closed" alternate mask bracket shown in FIG. 18*k*.

FIG. 18*j* illustrates a top view of the "open" alternate mask bracket shown in FIG. 18*k*.

FIG. 18*k* illustrates a side view of the alternate mask bracket shown in FIG. 18*a*.

FIG. 18*l* illustrates a top view of the alternate mask bracket shown in FIG. 18*a*.

FIG. 18*m* illustrates a top view of the "closed" alternate mask bracket shown in FIG. 18*a*.

FIG. 18*n* illustrates a top view of the "open" alternate mask bracket shown in FIG. 18*a*.

FIG. 18*o* illustrates a side view of the alternate mask bracket shown in FIG. 18*a*.

FIG. 21*c* is a mask skeleton consistent with the embodiment shown in FIG. 21*a* of the present application.

FIG. 21*d* is a close-up view of the eyeglasses retainer shown in FIG. 21*c* of the present application.

FIG. 21*e* is a close up side view of a user implementing the eyeglasses retainer feature as shown in FIG. 21*c*.

DETAILED DESCRIPTION OF THE EMBODIMENTS

The preferred embodiments of the present invention will now be described with reference to the drawings.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

When introducing elements of the present disclosure or the embodiments thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Referring now to FIGS. 1*a*-4*c*, shown are various brackets 100*a*, 100*b*, 100*c*, 100*d* in accordance with embodiments of the present application. Preferably, the system, regardless of embodiment, will employ two brackets which may be the same or different as the other bracket used in the system. The configuration may depend upon user comfort or other necessities.

Each of the bracket 100*a*, 100*b*, 100*c*, and 100*d* preferably are formed from a polymer chosen for its flexibility yet resiliency. Polymers chose may include but are not limited to polyethylene terephthalate (PET), polyethylene (PE), high-density polyethylene, polyvinyl chloride (PVC), polyvinylidene chloride (PVDC), low-density polyethylene (LDPE), polypropylene (PP), polystyrene (PS), high impact polystyrene (HIPS) and polycarbonate (PC), or any combination thereof. In further embodiments, the bracket may be formed from composites such as fiber reinforced plastics, metal composites, carbon fiber, and Kevlar® and the like or metals (preferably polymer coated metals) such as lightweight metals such as aluminum and other pure metals as well as various alloys.

Figure 7:
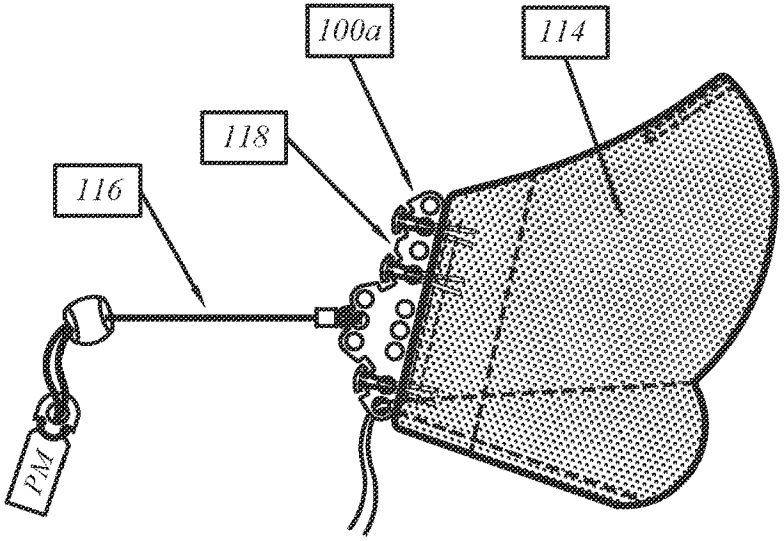
FIG. 7 is a profile of a user wearing a mask with a third embodiment of the present application.
Figure 10:
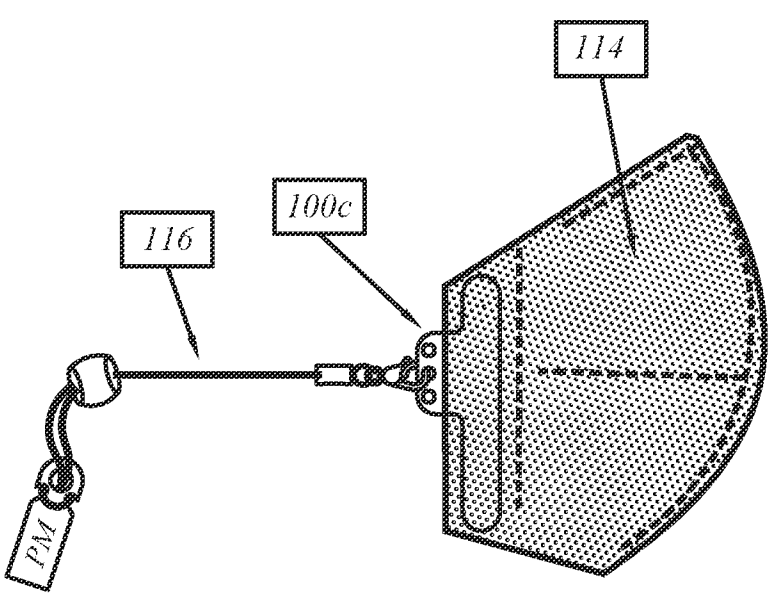
FIG. 10 is a profile of a user wearing a mask with a sixth embodiment of the present application.

Each bracket 100*a*, 100*b*, 100*c*, 100*d* is preferably is a unitary structure formed from a single construct. The bracket 100*a*, 100*b*, 100*c*, 100*d* as shown may have a securement edge 112 which can be used to adhere (via mechanical or chemical means) the bracket 100*a*, 100*b*, 100*c*, 100*d* to the mask body 114 (see at least FIGS. 7-8). Each bracket 100*a*, 100*b*, 100*c*, 100*d* generally has a plurality of apertures 102. In at least two embodiments shown in FIGS. 1*a*-2*c* may have least one hook 104 disposed throughout the bracket body. Each hook 104 may be formed from at least a neck portion 106 and a retainment bar 110. The arrangement of the apertures 102 and the hook(s) 104 of the bracket may vary as required by the user or the mask in which the bracket is to be utilized.

In at least two embodiments as shown in FIGS. 3*a*-4*c* there may be a protruding portion 108. The protrusion or protruding portion 108 which protrudes outwardly from a central portion of the bracket. This protrusion 108 may have a number of apertures 102 thereon and may, in some embodiments, have one or more hooks 108 thereon. Each bracket 100*c*, 100*d* is designed to be adhered to a mask thereby removing the need for an elastic strap of the mask to be worn around the user's ears.

Figure 17A:
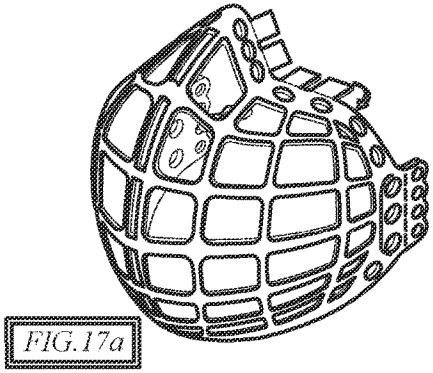
FIG. 17*a* is a first embodiment of a mask skeleton in accordance with an embodiment of the present application.
Figure 17B:
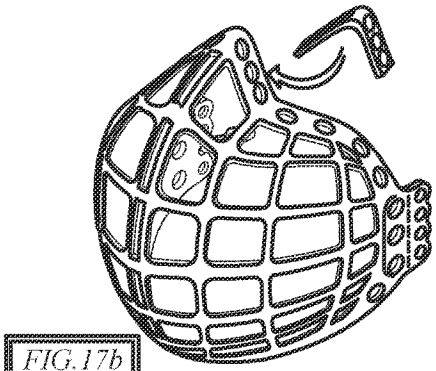
FIG. 17*b* is a second embodiment of a mask skeleton in accordance with an embodiment of the present application.
Figure 17C:
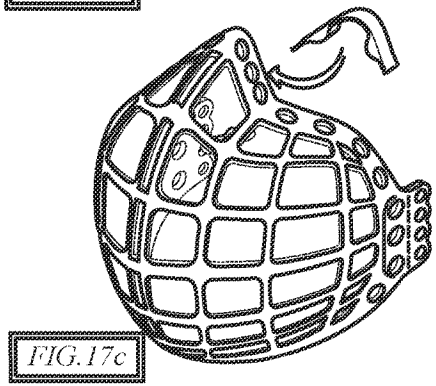
FIG. 17*c* is a third embodiment of a mask skeleton in accordance with an embodiment of the present application.
Figure 18A:
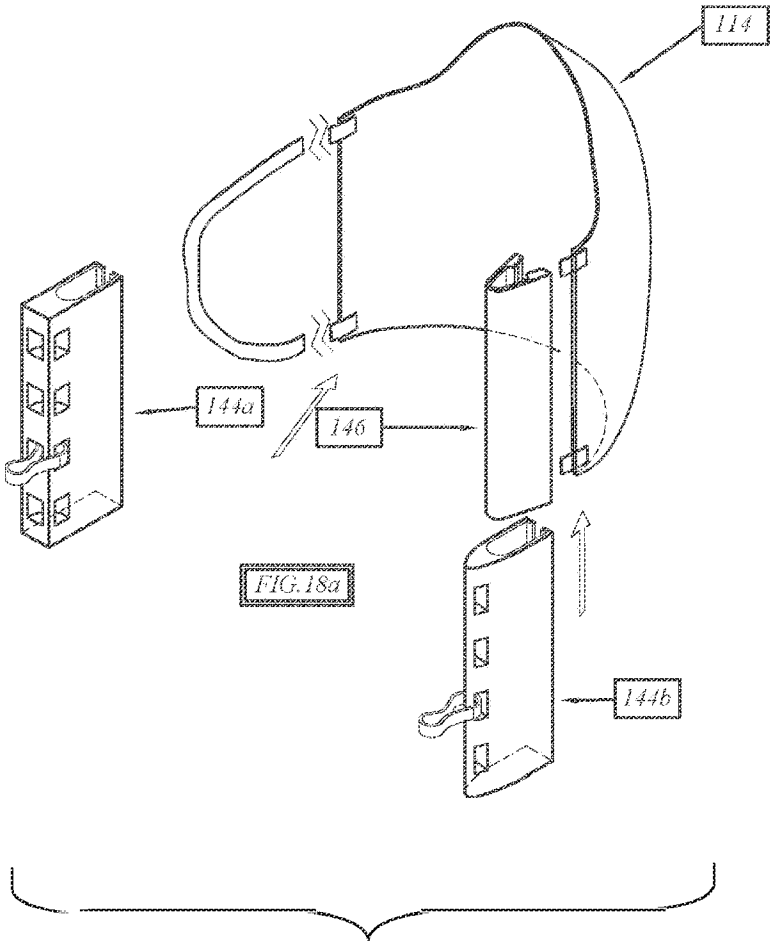
FIG. 18*a* illustrates an alternate mask bracket in accordance with the present application.
Figure 18D:
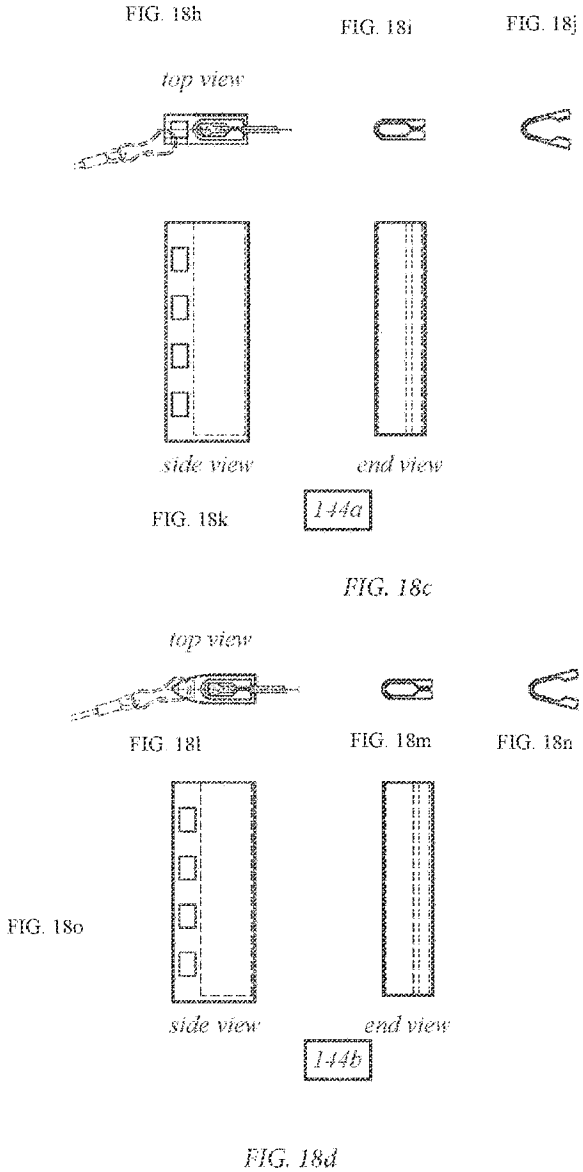
FIG. 18*d* illustrates a second alternate mask bracket as shown in FIG. 18*a*.

An alternative form of the bracket is shown in FIGS. 17-18O as a first securement mechanism 144*a* and a second securement mechanism 144*b*. Here, the securement mechanism uses a "clamping" movement to secure a position of the mask. Each bracket has a plurality of openings which allow for the clip of the fastening strap 116 to be secured thereto. Each securement mechanism further has a first position and a second position. The clamping mechanism 146 is slid into either of the first securement mechanism 144*a* or the second securement mechanism 144*b*. As the clamping mechanism 146 is slid into the securement mechanism 144*a*, 144*b*, the form factor of the securement mechanism 144*a*, 144*b* causes the clamping mechanism 146 is close on either the mask body 114 as shown in FIG. 17 or the rods 150 attached to the mask body 114 as shown in FIGS. 18A-O.

In at least one embodiment, a mask may have a rod 150, as previously noted, along a length of a first edge and a second edge of the mask. The rod 150 may be generally of any size/shape and the rod may be formed from virtually any suitable material and adhered to the mask body 114. The securement mechanism may be shaped specifically to receive the rod and may have a shape the is complimentary to the rod to ensure a secure fit.

Referring to FIGS. 1*a*-4*c*, the bracket 100*a*, 100*b*, 100*c*, 100*d*, once attached to a mask body 114, will appear as shown in FIGS. 5-12. Here, there are various attachment conformations shown and further described herein.

Figure 6:
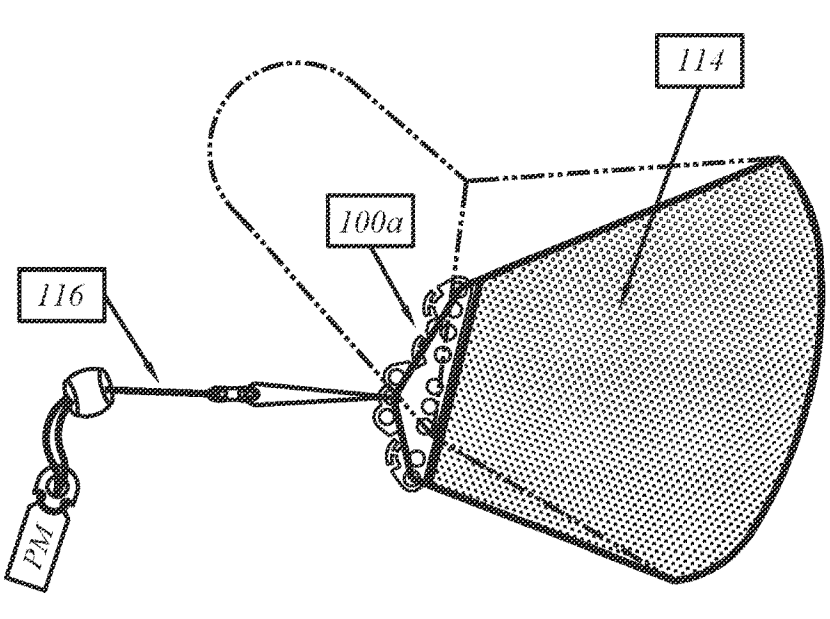
FIG. 6 is a profile of a user wearing a mask with a second embodiment of the present application.
Figure 5:
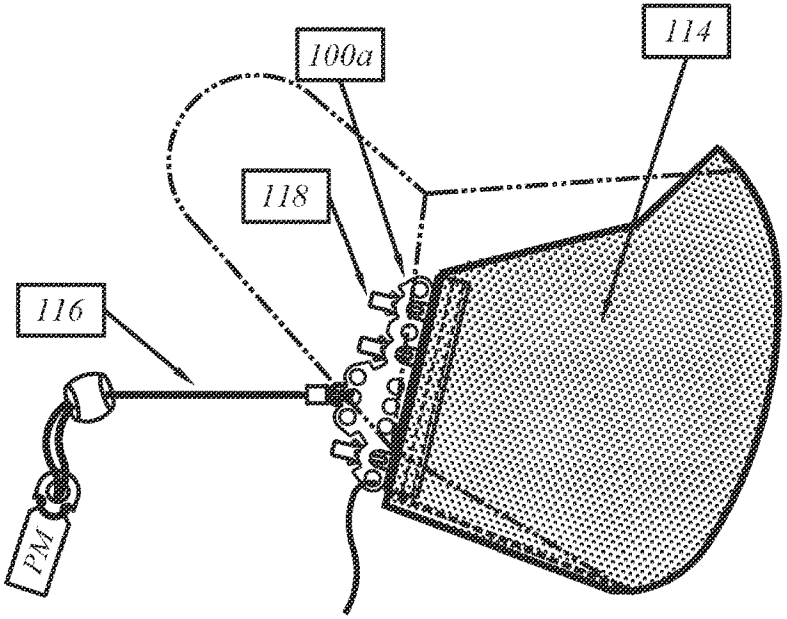
FIG. 5 is a profile of a user wearing a mask with an embodiment of the present application.

For example, in FIG. 5, is a first methodology using optional tabs 118 to facilitate the connection at the interface between the elastic strap of the mask and the bracket 100*a*, 100*b*, 100*c*, 100*d*. A fastening strap 116 is then directly affixed to the bracket 100*a*, 100*b*, 100*c*, 100*d*. In FIG. 6, there is a separate attachment methodology where the elastic strap of the mask is woven and pulled through the attachment points (apertures 102 and hook(s) 108) of the bracket 100*a*, 100*b*, 100*c*, 100*d* to be further attached to a fastening strap 116.

Figure 13B:
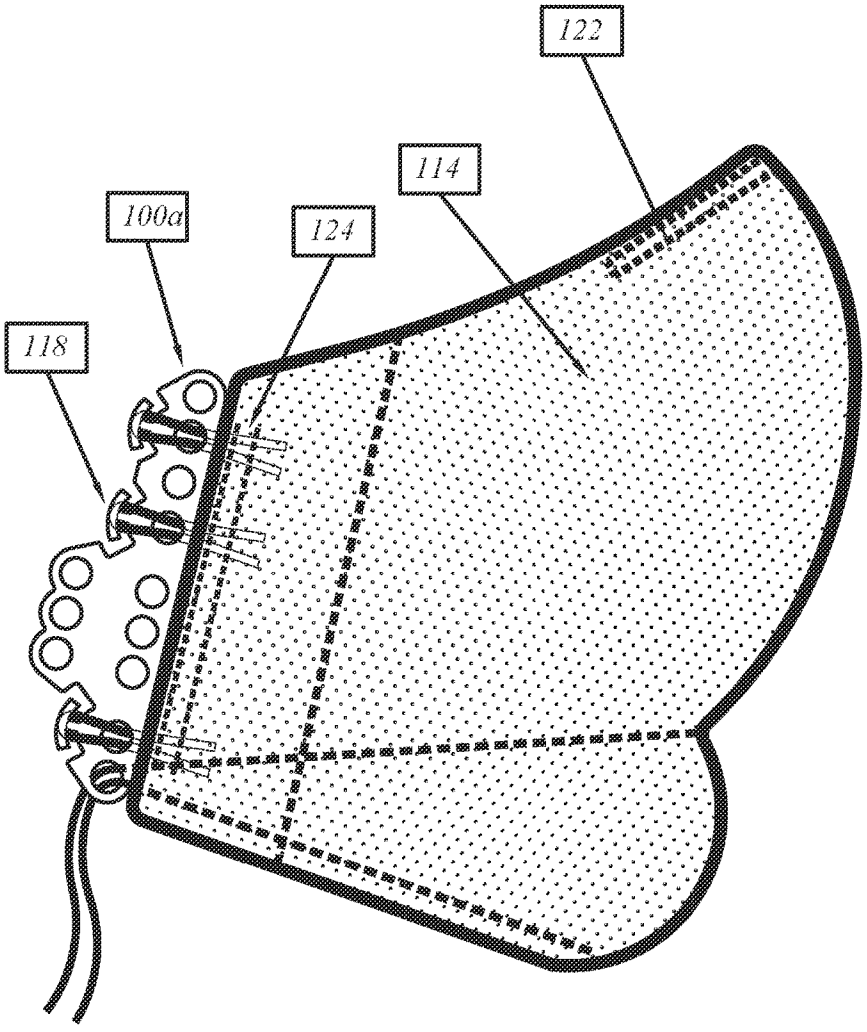
FIG. 13*b* is a profile of a mask of an embodiment of the present application with a mask bracket attached thereto.
Figure 13A:
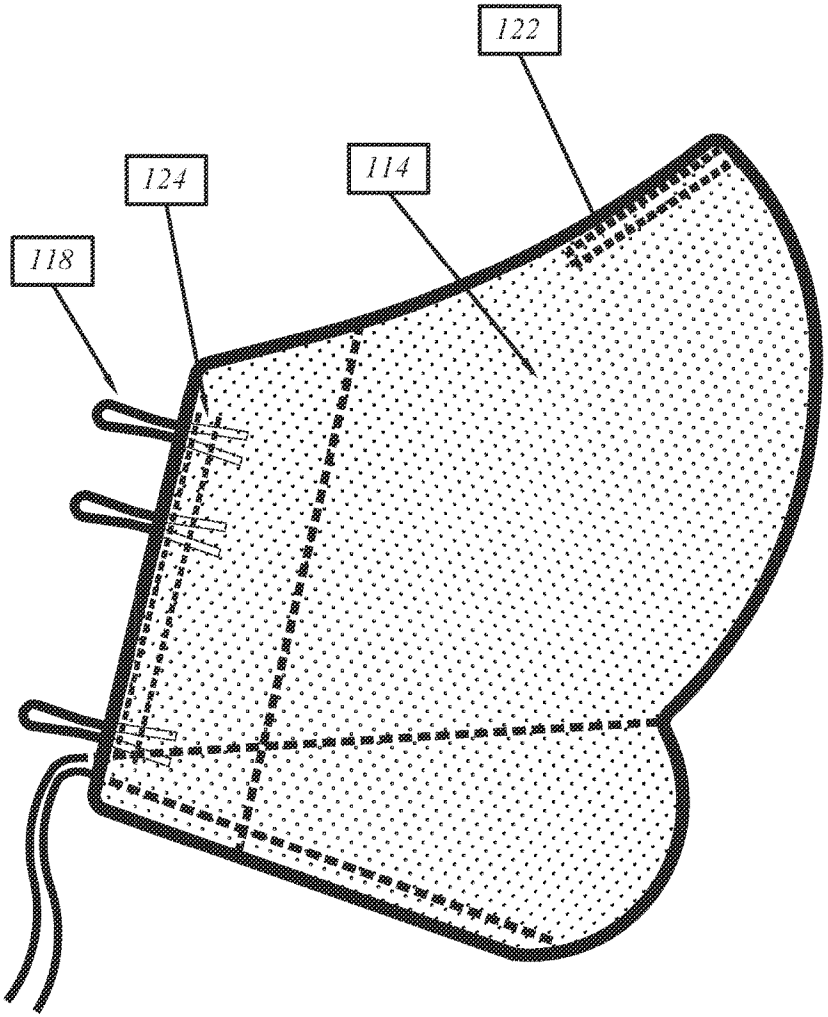
FIG. 13*a* is a profile of a mask of an embodiment of the present application without a mask bracket attached thereto with the attachment point being on an edge of the mask.

The tab connection methodology is further illustrated in FIGS. 13*a*-*d*. Here, the mask body 114 is shown with and without the attached bracket. In FIG. 13*a*, the mask body 114 is shown with the tabs 118 coupled thereto. In this embodiment, the tabs 118 are formed loops of material that may form a fully enclosed loop or may have a break in a portion of the loop. In at least one embodiment, the tabs 118 take the form of larger, rectangular piece of material having an aperture as shown in FIG. 5. Here, the aperture is fit around the hook 104 as described herein. More generally, the tabs 118 may be affixed via stitching to the mask body 114 as well as the bracket. Such a configuration of the system is shown on a profile of a user in FIG. 5.

As shown in FIG. 13*b*, the bracket has been coupled to the mask body 114 along a securement edge 112 of the bracket. The bracket may be coupled via mechanical or chemical (or other) means such as stitching 124 or adhesives (not shown). The tabs 118 may further be coupled to the mask body 114 by the same or similar means. The tabs 118 are configured to engage the hooks 104 of the bracket. Each tab 118 fits around the retainment bar 110 and sits around the neck 106 of the hook 104. This configuration allows for additional support of the mask by the bracket. It further allows for selective positioning of the tabs 118 for a modification to the fit of the mask on the user.

Figure 8:
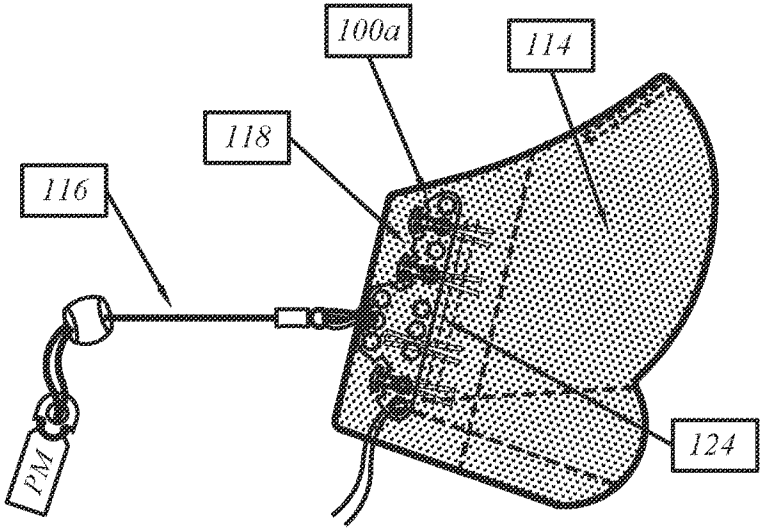
FIG. 8 is a profile of a user wearing a mask with a fourth embodiment of the present application.
Figure 9:
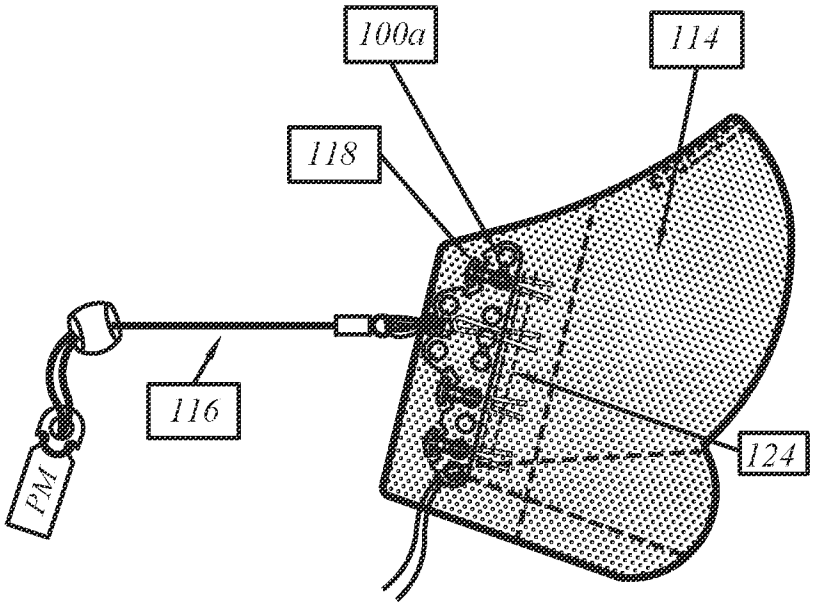
FIG. 9 is a profile of a user wearing a mask with a fifth embodiment of the present application.
Figure 12:
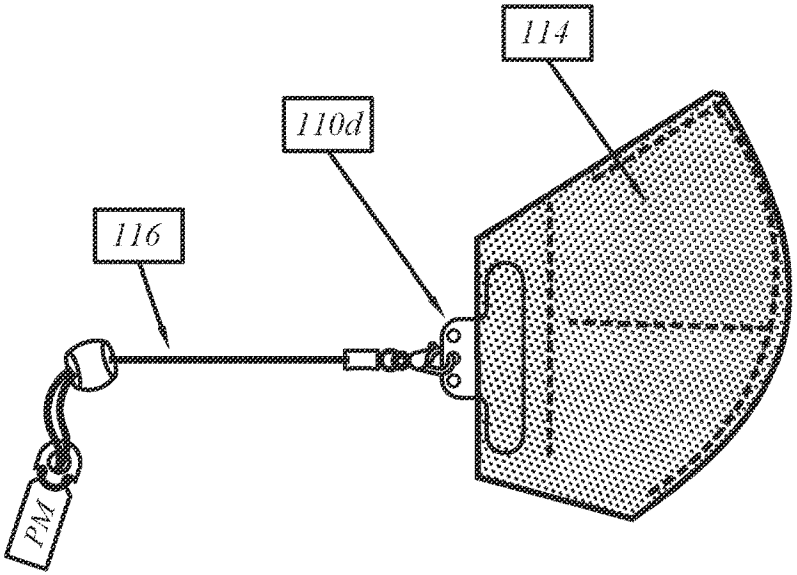
FIG. 12 is a profile of a user wearing a mask with an eighth embodiment of the present application.
Figure 11:
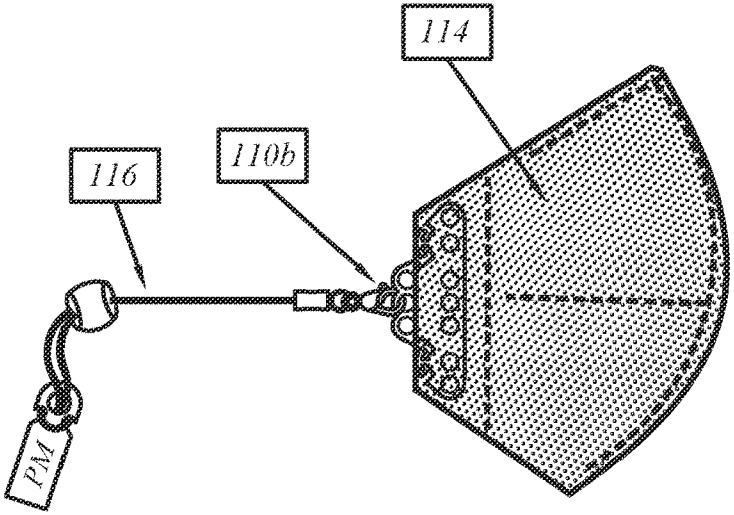
FIG. 11 is a profile of a user wearing a mask with a seventh embodiment of the present application.
Figure 13D:
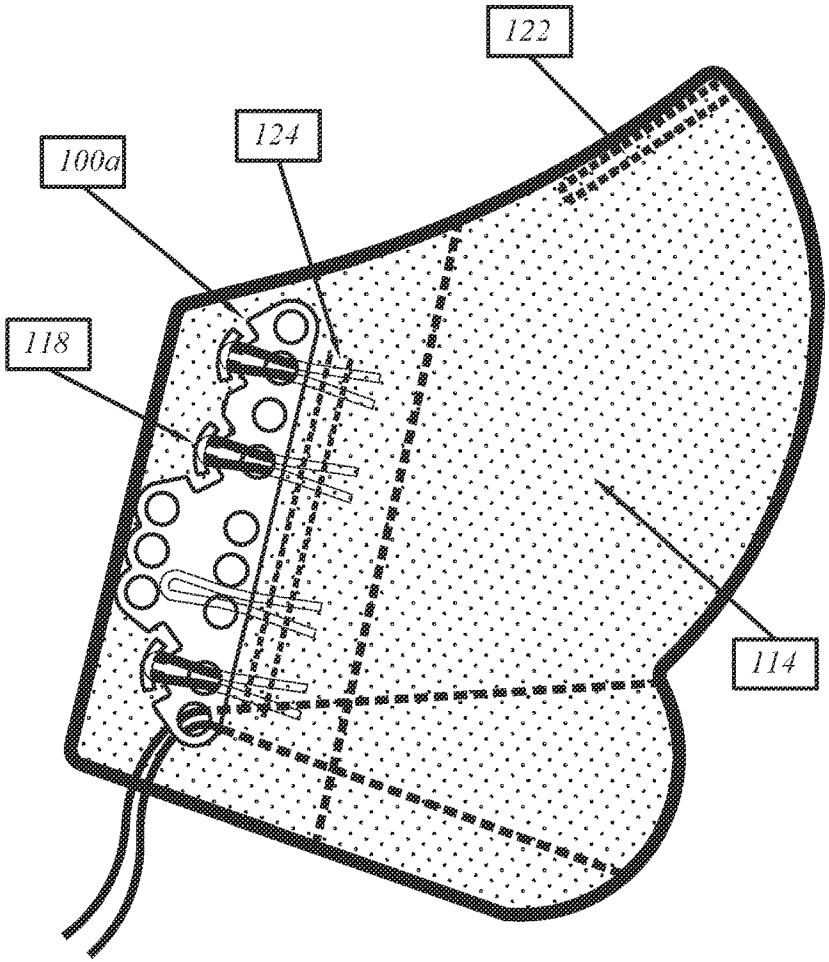
FIG. 13*d* is a profile of a mask of an embodiment of the present application with a mask bracket attached thereto with the attachment point being on a body of the mask.
Figure 13C:
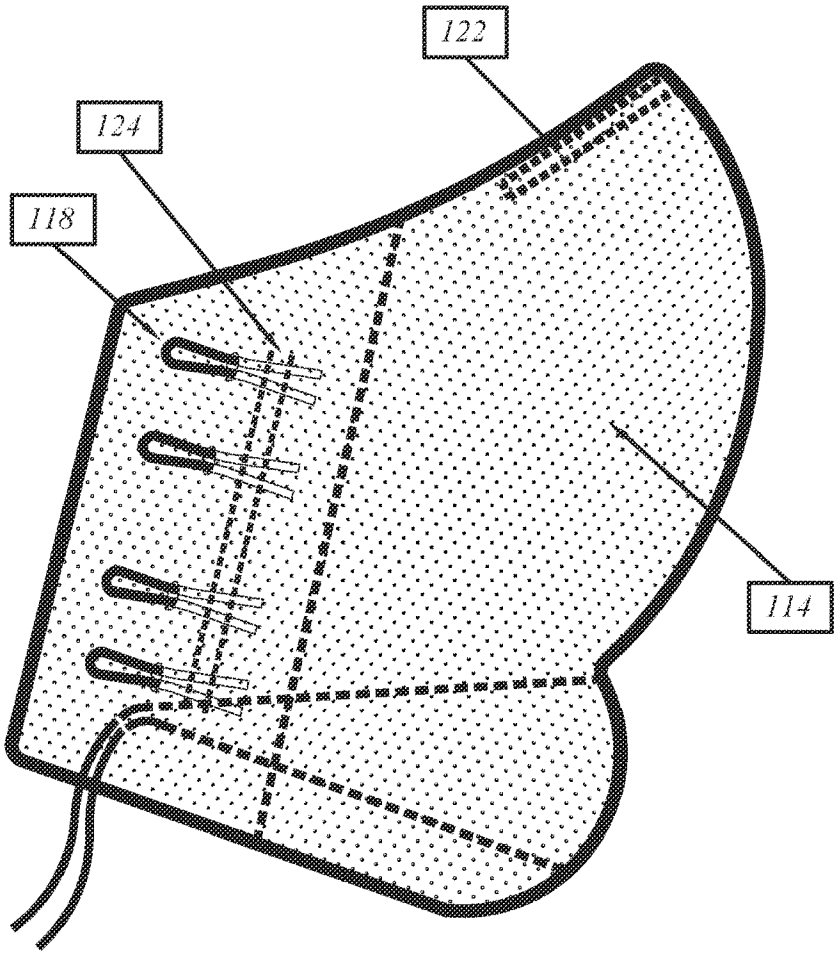
FIG. 13*c* is a profile of a mask of an embodiment of the present application without a mask bracket attached thereto with the attachment point being on a body of the mask.

In FIGS. 13*c*-13*d*, the bracket, has been attached in a similar manner but further inwards on the mask body 114. This conformation is further shown in FIGS. 8 and 9. Here, are side profiles of a user wearing the bracket on an inward portion of the mask body 114. However, in each Figure the bracket is worn in a different conformation. In FIG. 8, the bracket is shown with a protruding portion 108 in a lower direction directed toward a bottom of the mask. This protruding portion 108 further is shown coupled to the fastening strap 116. The positioning of the bracket in this conformation allows the fastening strap 116 to be worn "lower" on the user's neck. In FIG. 9, the bracket has been flipped 180° about a vertical axis thereby putting the protruding portion 108 closer to a top of the mask. This allows the fastening strap 116 to be worn "higher" on the user's neck. The point at which the fastening strap 116 is to be worn may be user's preference, but also may be situational based on a user's job, need for visibility, etc.

The other bracket embodiments shown herein, particularly in FIGS. 3*a*-4*c* incur the same principles as discussed above and as shown in FIGS. 10-12.

As previously noted, and as shown in FIG. 6, the existing elastic strap of the mask may engage the bracket in order to redirect the elastic strap such that it does not need to be positioned around the ears of a user. Here, the existing elastic strap is "woven" through at least one, and preferably more than one, aperture 102 in the bracket. The weaving of the elastic strap through said apertures 102 puts tension on the elastic strap thereby securing a position of the strap. As shown, a portion of the strap can then be pulled away from the bracket. A clip of the fastening strap 116 can then be coupled to the loop formed from the existing elastic strap thereby coupling the mask to the user and directing the existing elastic strap below the ears of the user. The fastening strap 116 is configured to reside around the user's neck.

Further, the fastening strap 116 may generally take the construct of a known "lanyard" with a depressible clip on each end of the length of material forming the lanyard. However, in other embodiments the fastening strap 116 may comprise a semi-rigid frame thereby allowing the fastening strap 116 to be shaped and retain that shape until otherwise manipulated by the user. The fastening strap 116 may have segments which may be individually manipulated and shaped to thereby provide a custom shape and fit to the fastening strap 116 based on the user's needs and other variables.

Figure 14:
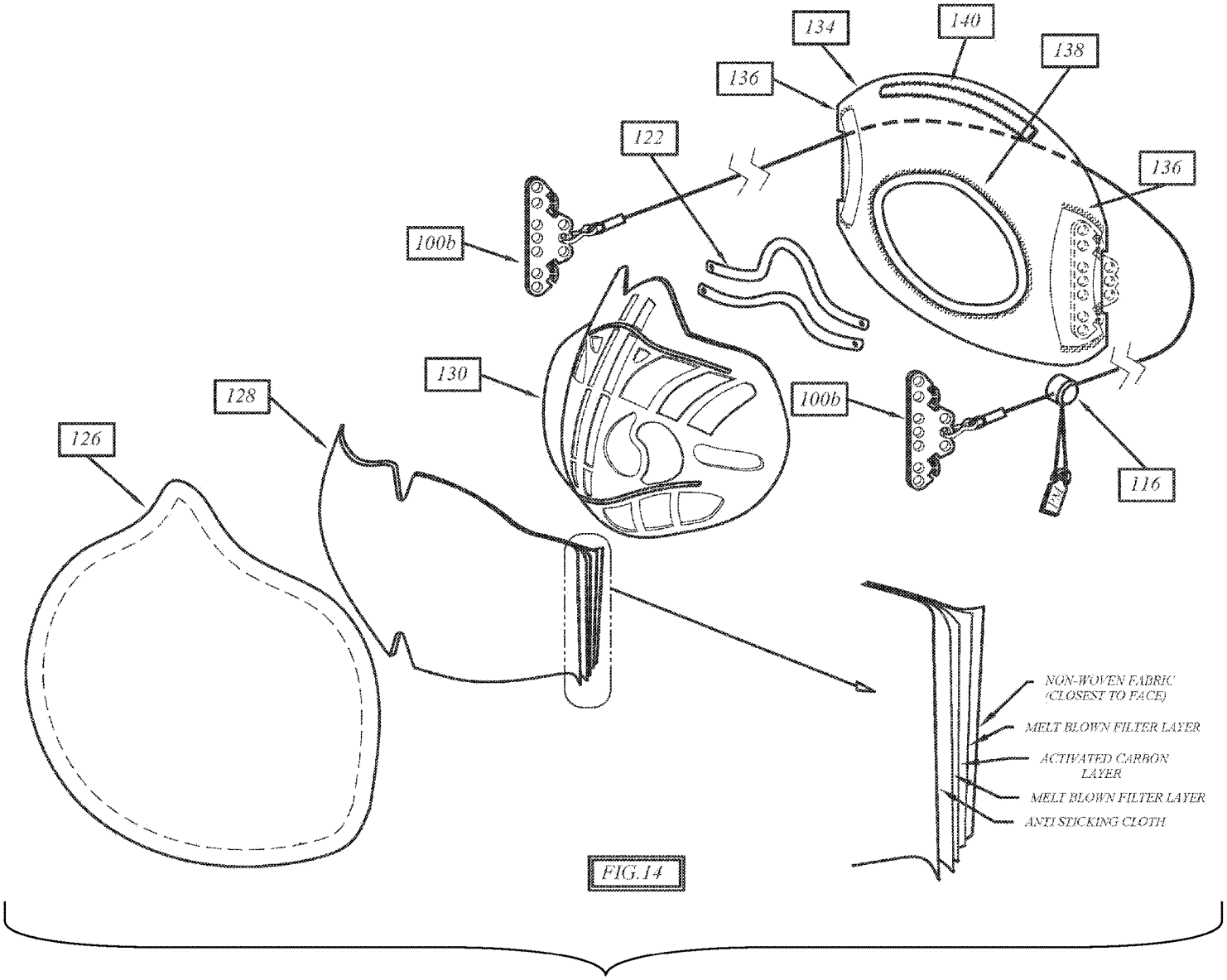
FIG. 14 is an exploded view of the components of a mask plus bracket system in accordance with one embodiment the present application.

As shown in FIGS. 14-17*c*, there is a complete facial covering system in according with the embodiments of the present invention. In FIG. 14, there is an exploded view of a first embodiment of a facial covering system. Here there is an outer layer 126, filter layer 128, mask skeleton 130, bracket 100*b*, inner layer 134, fastening strap 116, inner layer bracket pocket 136, inner layer strip pocket 140, central aperture 138, and positioning strip 122.

The layers are such that the outer layer 126 is positioned most outwardly away from the user, the filter layer 128 is coupled to an inner surface of the outer layer 126, the mask skeleton 130 is coupled to an inner surface of the filter layer 128, and the inner layer 134 is coupled to an inner surface of the mask skeleton 130.

The outer layer 126 is a textile layer preferably comprised of a poly cotton Lycra® or another suitable textile. The filter layer 128 may be comprised of one or more layers which may consist of a non-woven fabric layer, melt blown fabric layer, activate carbon layer, and an anti-sticking cloth, or any combination thereof. In some embodiments, there are more or less than said layers and some layers may be duplicated in the construct. In a preferred embodiment, the layers are arranged as: non-woven fabric layer (innermost layer); melt blown filter layer; activated carbon layer; melt blown filter layer, and anti-sticking cloth layer (outermost layer). The two melt blown layers "sandwich" the activated carbon layer.

In at least one embodiment, the filter layer 128 and the outer layer 126 are a singular layer comprised of known materials. In at least one embodiment, the layer(s) or material fitted to the mask skeleton 130 is of at least N95 quality or in other embodiments, complies with at least P95, KN95, or other known standards. The material will be, regardless, custom fit and custom secured to the mask skeleton 130.

The mask skeleton 130 is configured to provide rigidity to the facial covering system as well as to prevent the mask layers from obstructing the user's mouth and/or nose. To that effect, the mask skeleton 130 is shaped such that a central portion of the mask skeleton 130 is humped thereby formed a recess or cup-shape. The mask skeleton 130 further has a plurality of apertures to aid in the breathability of the system. The mask skeleton 130 may be formed from the same materials as the bracket previously noted herein.

The inner layer 134 is a textile layer preferably comprised of a poly cotton Lycra blend as with the outer layer 126. The inner layer 134 further comprises two bracket pockets 136 and a strip pocket 140. The two bracket pockets 136 are positioned on each of a first side and a second side of the inner layer 134. The strip pocket 140 is positioned along a top edge of the inner layer 134.

Figure 16:
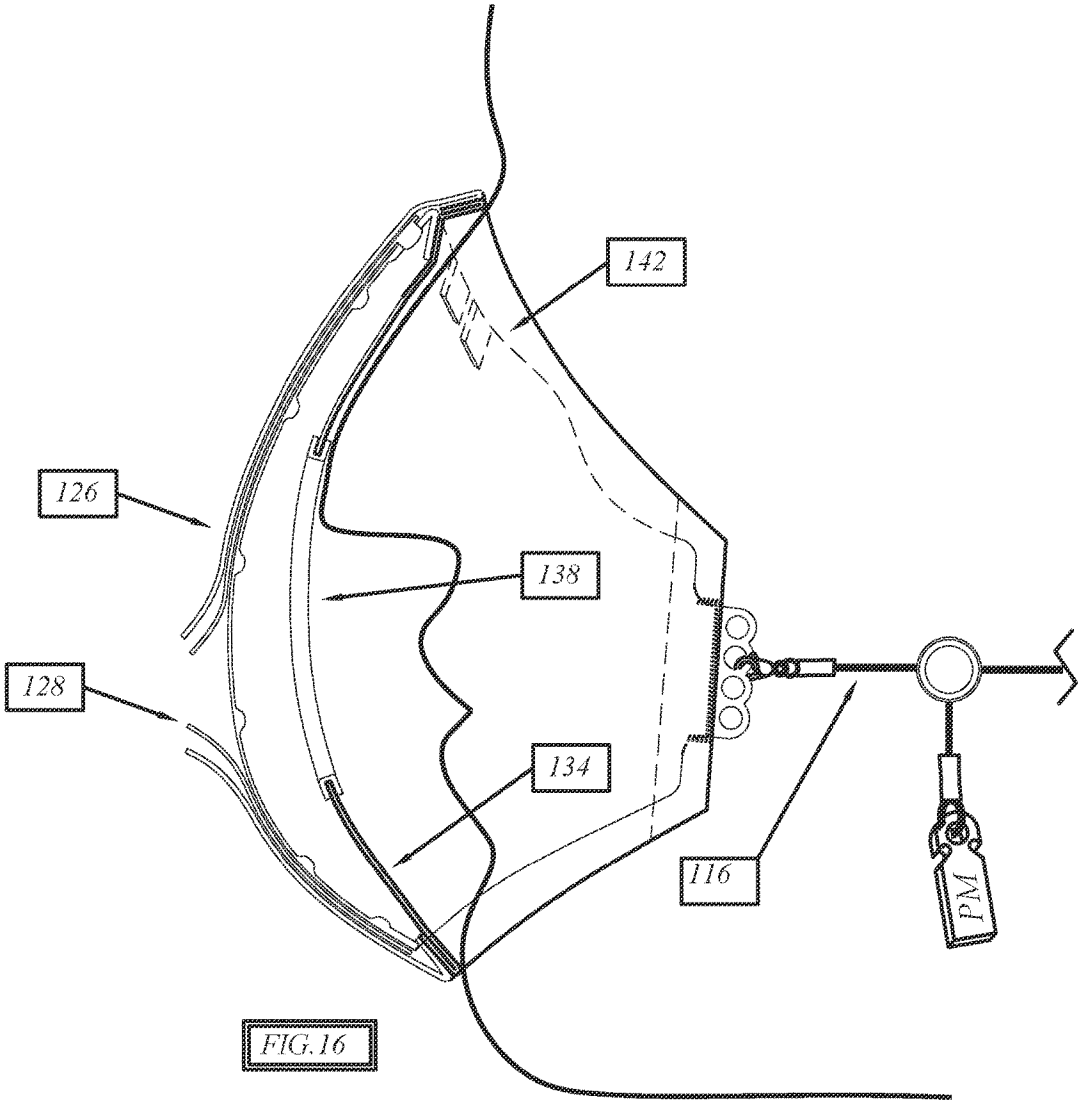
FIG. 16 is a sectional sideview of the components of a mask plus bracket system in accordance with the present application.

The two bracket pockets 136 are configured to individually receive the bracket. Each pocket may further have a securement mechanism, such as a hook and loop fastener, to help secure the pocket and the bracket therein. In other embodiments, the brackets are adhered to the pocket and retained therein via mechanical or chemical means as shown in FIG. 16. The strip pocket 140 is configured to receive the nose strip 122 therein and be retained by the strip pocket 140. The purpose of the nose strip 122 is to allow for conformation of the upper portion of the mask to the individual user's face. The nose strips 122 are formed form a thin piece of metal that may be readily molded and will retain its shape on molded. This prevents the breath exhaled by a user from being emitted unfiltered into the atmosphere as well as preventing glasses, googles, and the like from being fogged up by the user's breath.

Each bracket is to be coupled, preferably by a clip or other similarly situated device, to the fastening strap 116. The fastening strap 116 may be adjustable to provide a custom fit to an individual user. Once assembled, the facial covering system appears as shown in the profile view of the user in FIG. 16. Here, is shown how the mask skeleton 130 keeps the textile portions of the mask body 114 off the nose and/or mouth of the user thereby making it more tolerable to wear and easier to breathe. Further, the central aperture 138 of the inner layer 134 combined with the apertures of the mask skeleton 130 provide for enhanced breathability without sacrificing the filtering qualities provided by the filter layer 128. The bracket can further been seen to be readily retained by the pocket 136 and the fastening strap 116 is attached thereto.

Figure 15:
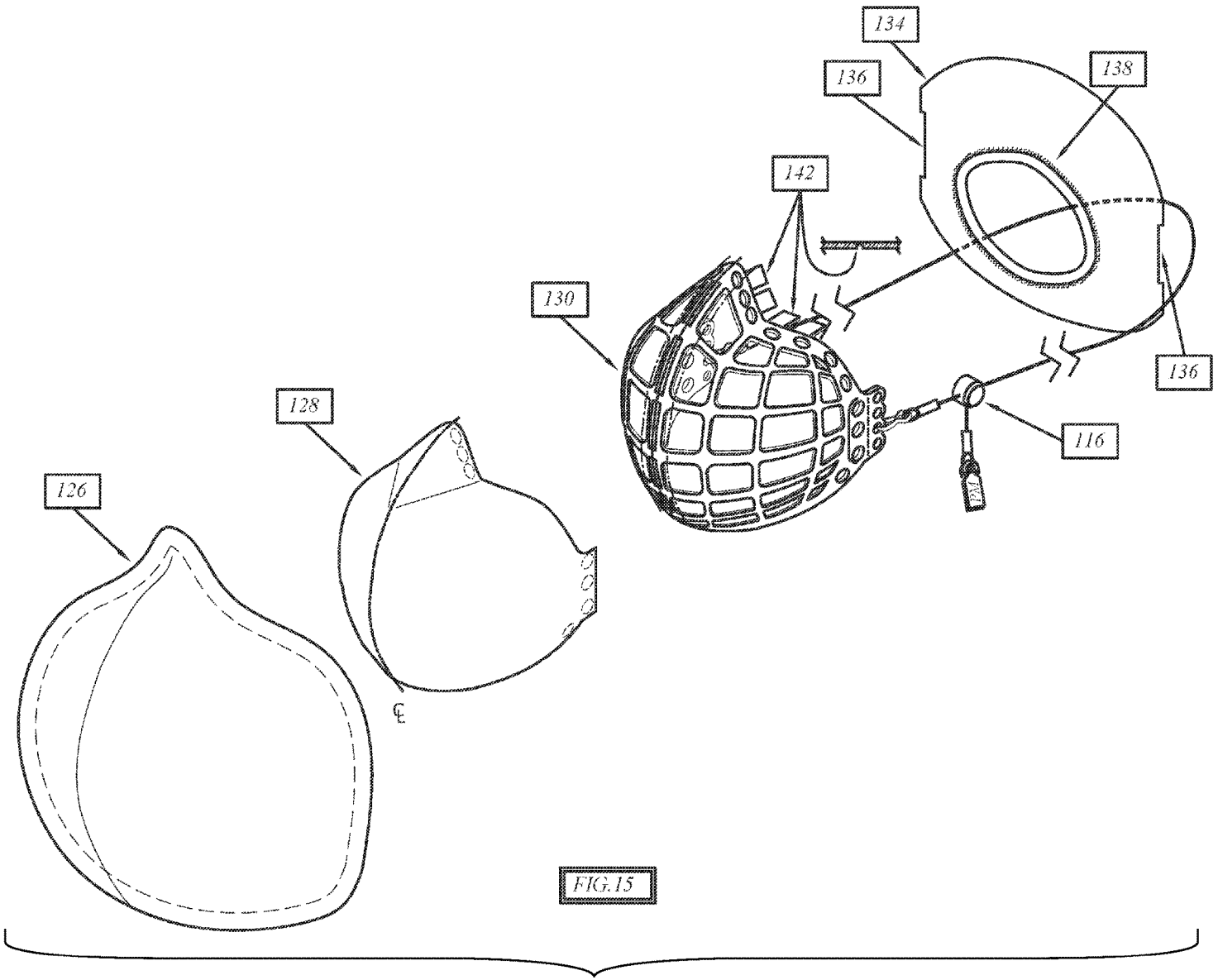
FIG. 15 is an exploded view of the components of a mask plus bracket system in accordance with an alternate embodiment of the present application.
Figure 15:
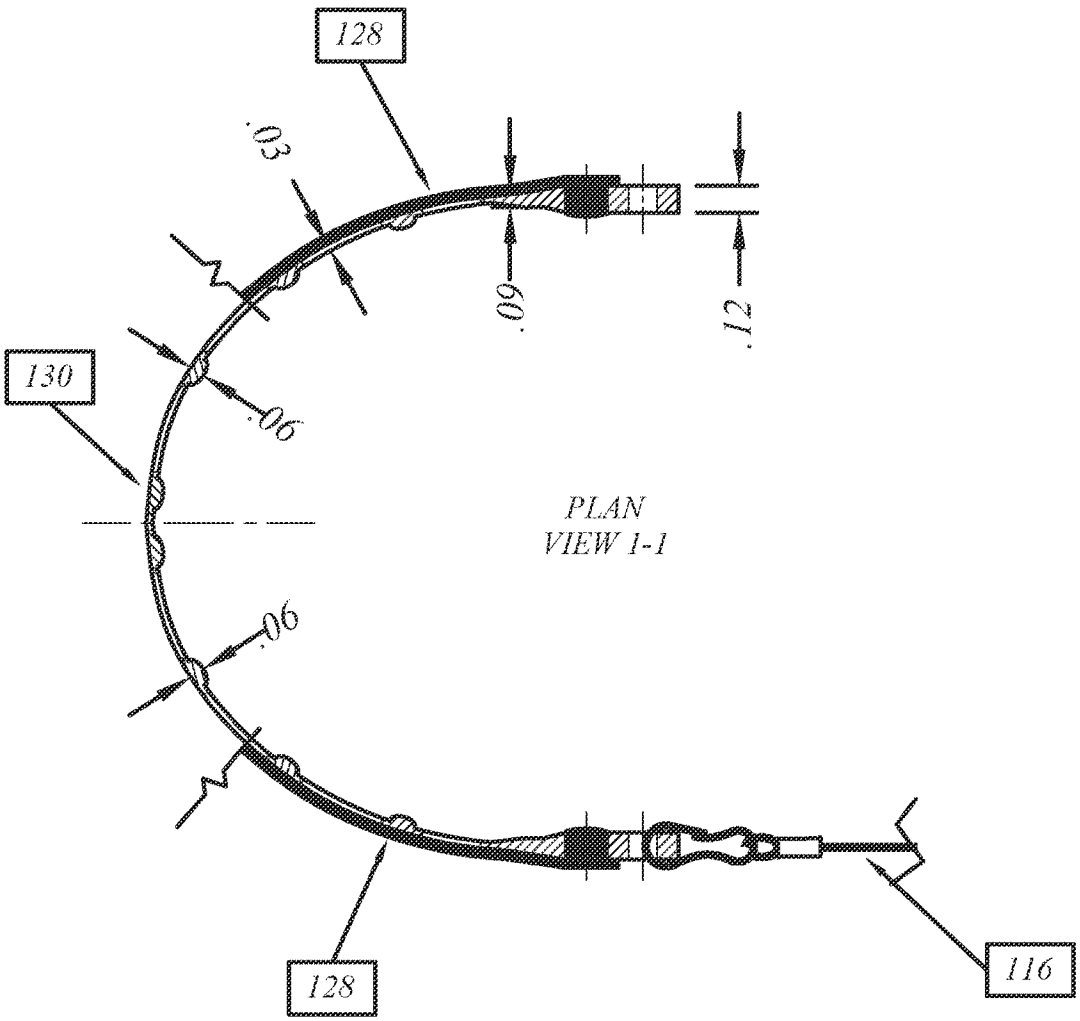

In another embodiment of the facial covering system, as shown in FIG. 15, the same general construct and layering of the mask elements is visible. However, there are some distinct and unique structural differences compared to the embodiment in FIG. 14.

The mask skeleton 130 has a plurality of tabs 142 along a top edge of the mask skeleton. The tabs 142 (further shown in FIG. 16) are folded in such a way that causes the tabs 142 to want to bend upwards. This causes the tabs 142, once the covering system is fully assembled, to push against the inner layer 134 thereby creating a sealing effect between the inner layer 134 and the skin surface of the user. This is desirable as the user then breathes through the central portion of the mask with the filtering properties as well as prevent glasses, googles, and the like from fogging due to the escaped breath.

Further, the mask skeleton 130 notably has apertures of a larger size and density. This again allows for a more effortless exchange of air when the user is breathing. The exact size and density of the apertures may vary but are virtually limitless as long as the structural integrity of the mask skeleton 130 is retained. The mask skeleton 130 also has a number of attachment points (apertures) along a first edge and a second edge of the mask skeleton 130. These attachment points mimic the bracket and removes the need for a separate bracket as it is essentially integrated into the mask skeleton 130. The fastening strap 116 can then be attached directly to the attachment points on the mask skeleton 130. The inner layer 134 may have a slightly different outer periphery to accommodate this change but otherwise remains unchanged.

Notably absent from the inner layer 134 are the pockets as previously discussed. This is due to the inclusion of the former pocketed structures (nose strip and bracket) being integrated with the mask skeleton 130 as noted above.

In FIGS. 17*a*-17*c*, there are shown differing nose cushions 180. In FIG. 17*a*, the nose cushion may be a molded feature that folds overs into the cloth or textile portion of the mask, which aids in conformation to the nose and seals the mask at the ridge of the nose. This serves to prevent eyeglass fogging. In FIG. 17*b*, the nose cushion 180 is a replaceable nose cushion that clips or otherwise attaches via a snap feature to the mask skeleton 130. In FIG. 17*c*, the nose cushion 180 uses an adhesive, such as tape, to adhere to the mask skeleton 130. While these permutations of the nose cushion 180 have been described it should be readily apparent that the exact form factor (e.g. shape) of the nose cushion 180 along with the mechanism of attachment may vary.

FIGS. 19*a*-20*b* demonstrate yet further iterations of the mask system in accordance with the present invention. Here, there is a more "stripped" down version of the mask system. Generally, this comprises the mask body 114, mask skeleton 130, fastening strap 116, ferrule 153, and attachment points 152.

Figure 19B:
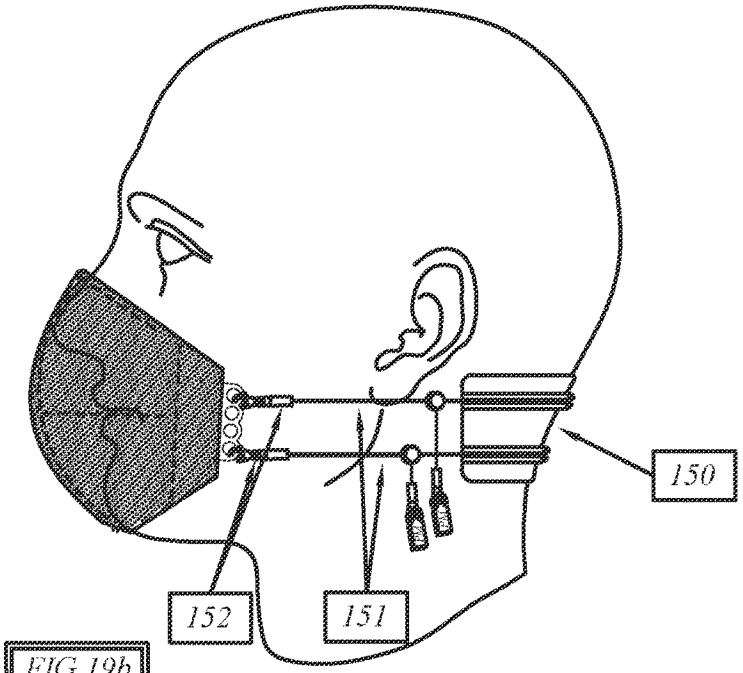
FIG. 19*b* is a double lanyard attachment shown attached to a mask skeleton of the present application as worn by a user.
Figure 19A:
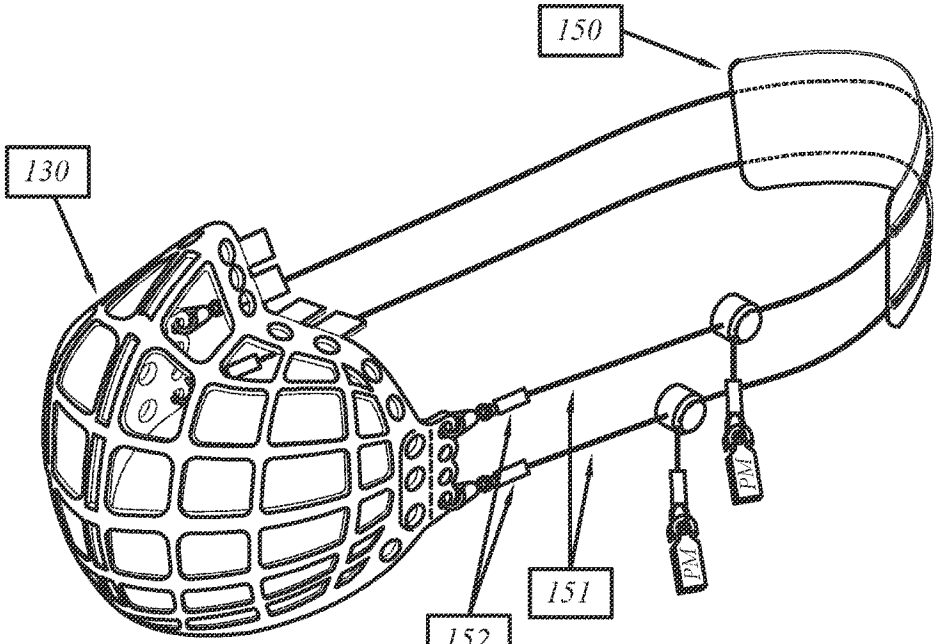
FIG. 19*a* is a double lanyard attachment shown attached to a mask skeleton of the present application.

As shown in FIGS. 19*a*-*b*, there is a dual fastening strap 116 version. The fastening strap 116 here comprises two separate straps that are independently coupled to the mask skeleton 130 by attachment points 152. A mask body 114 may then be coupled to the mask skeleton 130 (if not already present) to complete the system. The straps 116 are then worn around the user's neck as shown in FIG. 19*b*. An optional pad may provide additional protection to the user's neck. When the user has used the mask body 114 for a set duration, it is simply removed from the mask skeleton 130 and disposed. A new mask body may then be placed upon the mask skeleton 130.

Figure 20B:
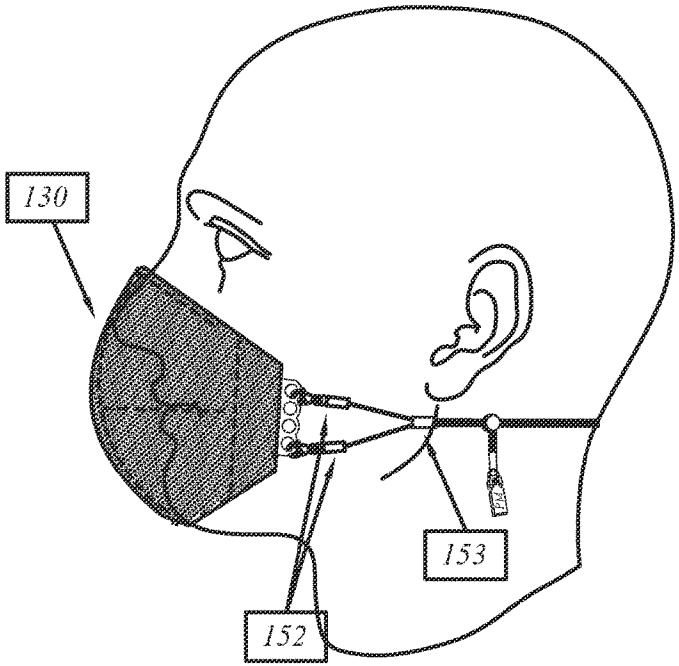
FIG. 20*b* is a double clip, single lanyard attachment shown attached to a mask skeleton of the present application as worn by a user.
Figure 20A:
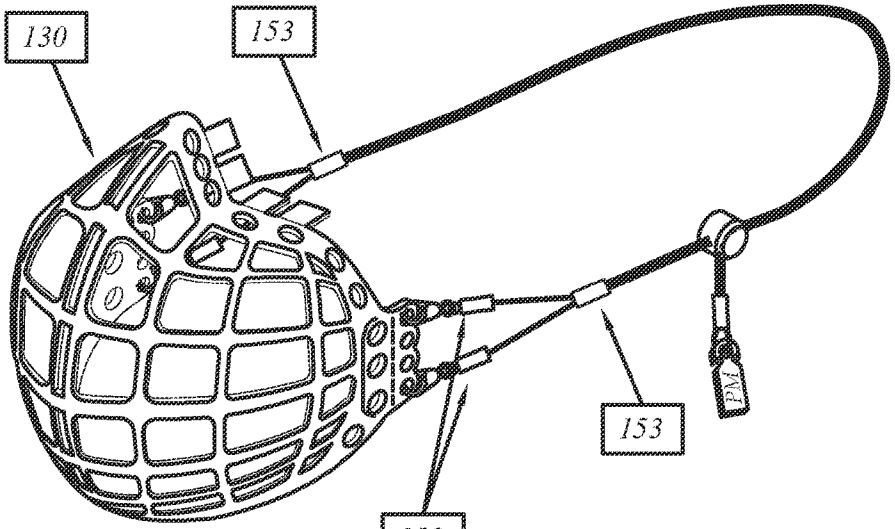
FIG. 20*a* is a double clip, single lanyard attachment shown attached to a mask skeleton of the present application.

In FIGS. 20*a*-20*b*, there is the same general principles as described in FIGS. 19*a*-*b* save for the fastening strap 116. Here, the fastening strap 116 has two ferrules 153 disposed thereon which allow for "splits" of the fastening strap 116 thereafter. This gives rise to a singular fastening strap 116 having two attachment points 152 on each of the first end and the second end of the strap. The dual or two attachment points allow for additional stability to the mask system without increasing the weight of the system of the ease of use of the system. All other structures and principles as described with respect to FIGS. 19*a*-19*b* are applicable to this embodiment.

Referring now to FIGS. 21*a*-24, there is shown another embodiment of the present application having a lip-reading window. Such an embodiments bears many of the structural features of the embodiments described herein. However, this embodiment has a perforated mask skeleton 130 which allows for a portion of the mask skeleton 130 to be removed.

Figure 21B:
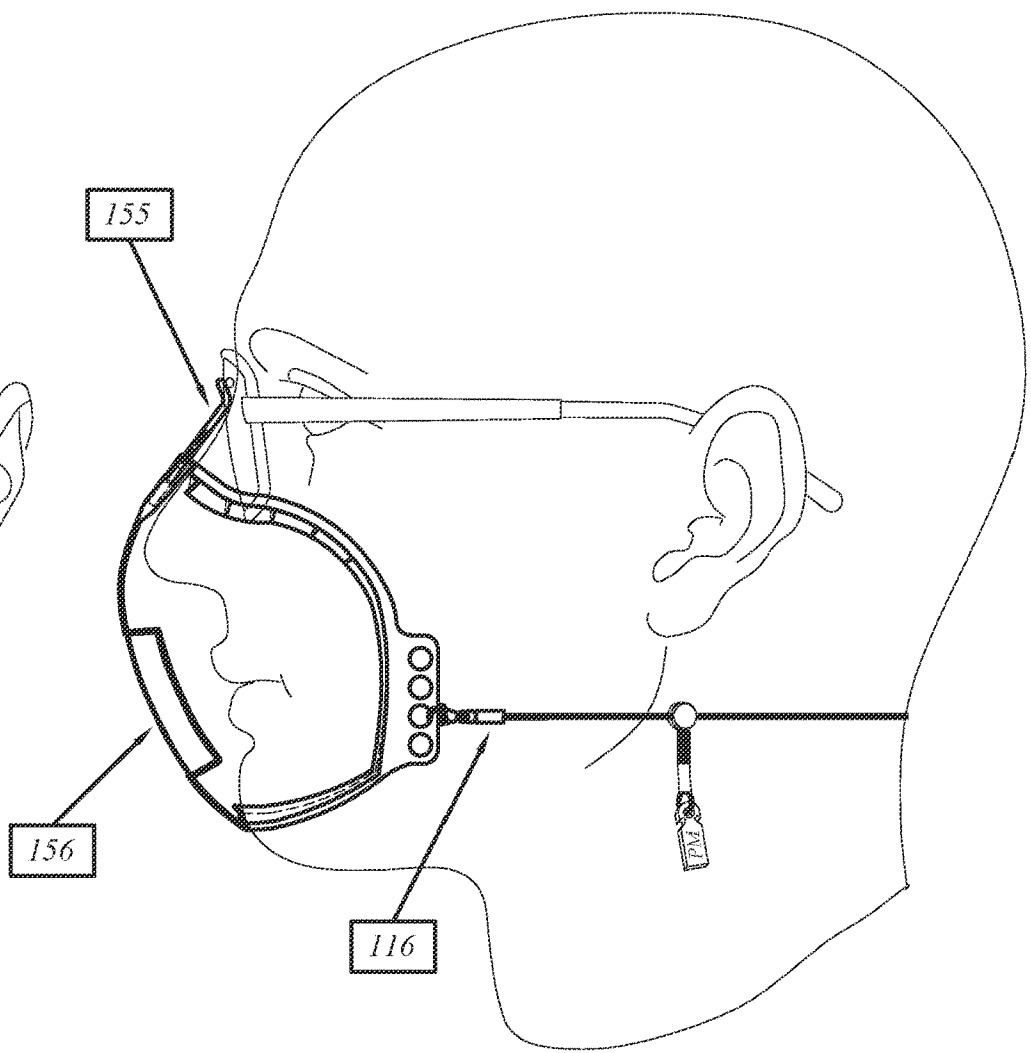
FIG. 21*b* is a side view of a user wearing the embodiment shown in FIG. 21*a* of the present application.
Figure 21A:
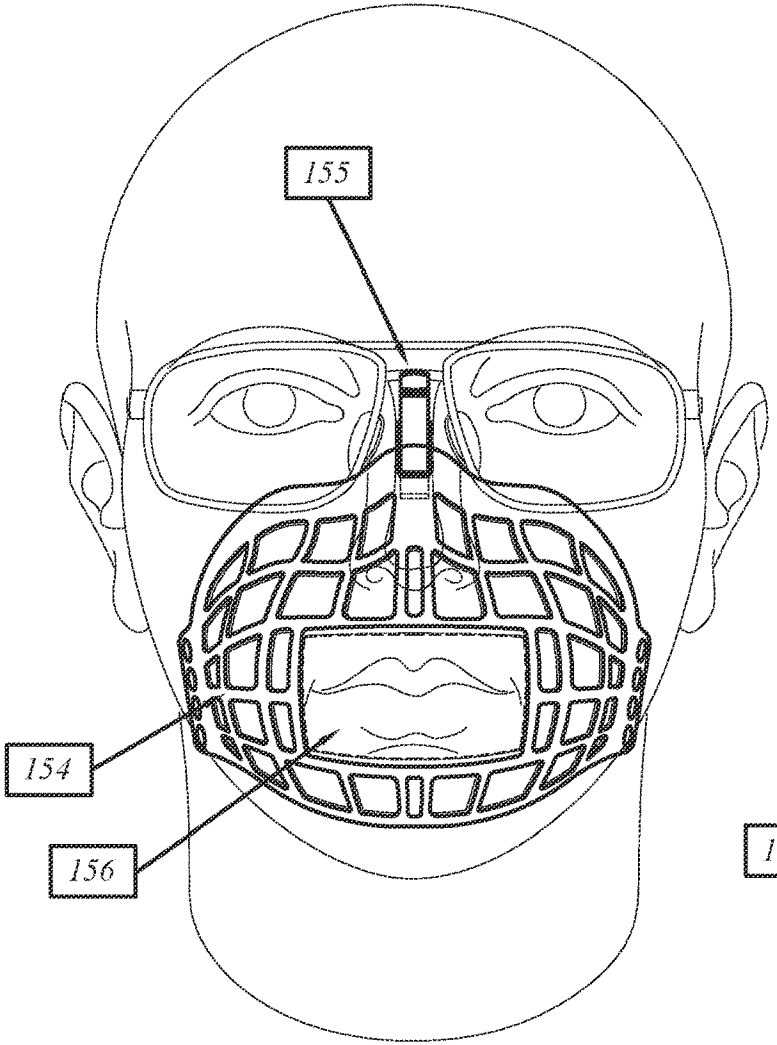
FIG. 21*a* is a front view of a user wearing another embodiment of the present application having a lip-reading window.
Figure 21F:
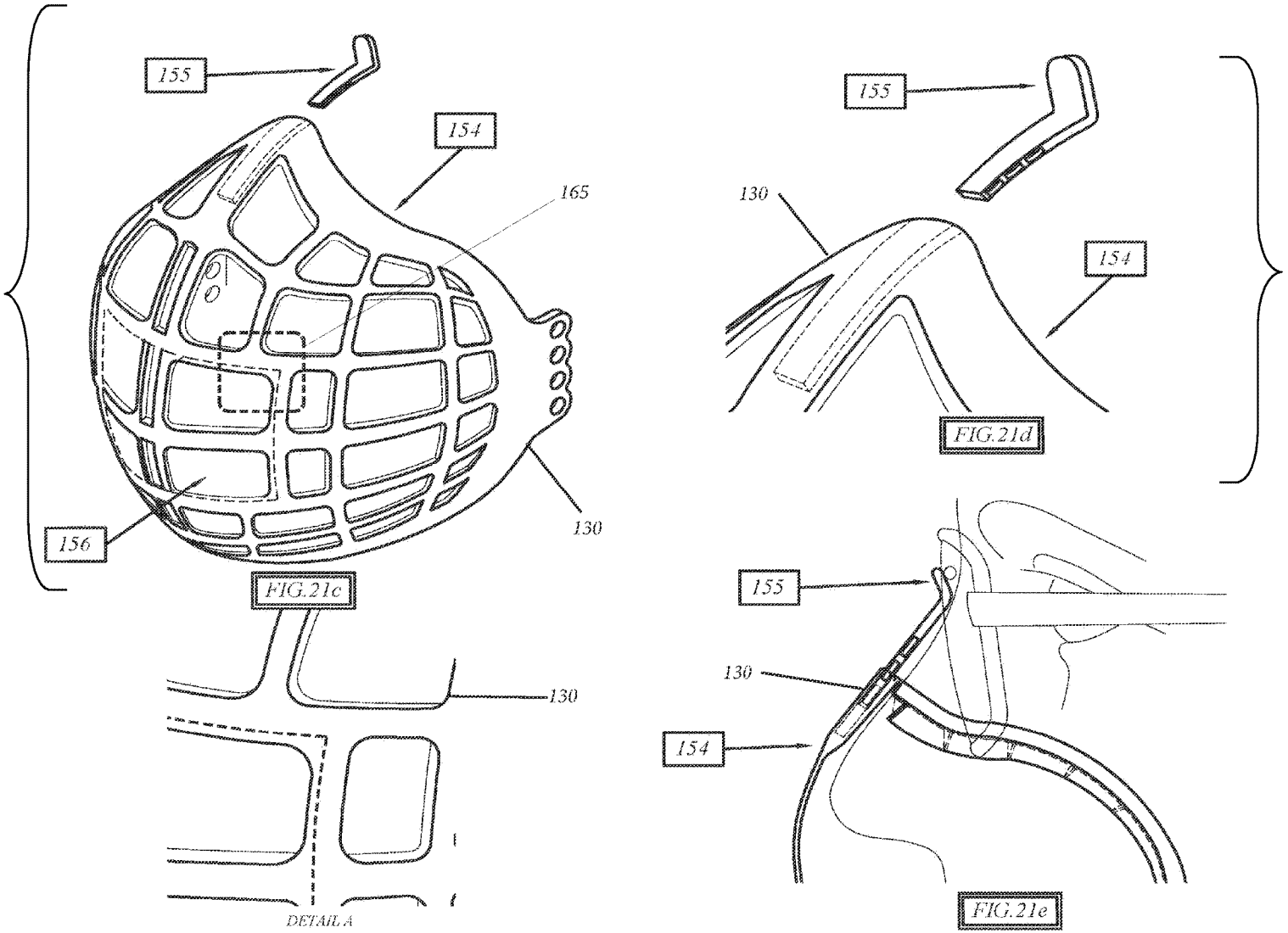
FIG. 21*f* is a close-up view of a perforation of a mask skeleton shown in FIG. 21*c*.

As shown in at least FIGS. 21*c*-*e*, a mask skeleton 130 is shown. The mask skeleton 130 is near identical to those embodiments previously described herein but has a perforation 156 that allows for a portion of the mask skeleton 130 to be removed. Once removed, as shown in at least FIGS. 21*a* and 21*b*, there is an opening or gap visible in the mask skeleton 130. The opening is preferably rectangular in shape to accommodate and make fully visible the mouth area of a user, however, alternative shapes and sizes are contained under the purview of this application.

Figure 22B:
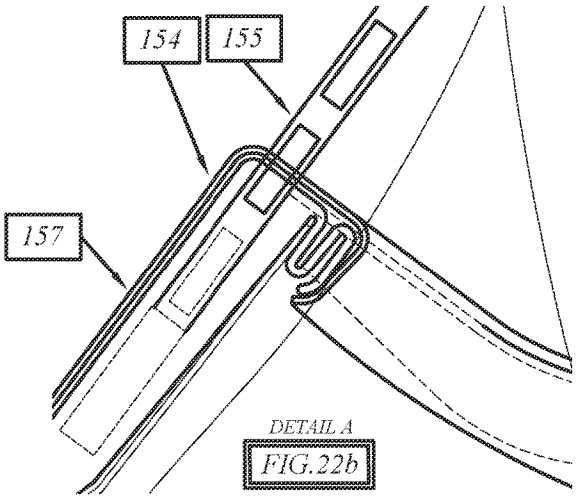
FIG. 22*b* is a close-up view of a baffle in a compressed position.
Figure 22C:
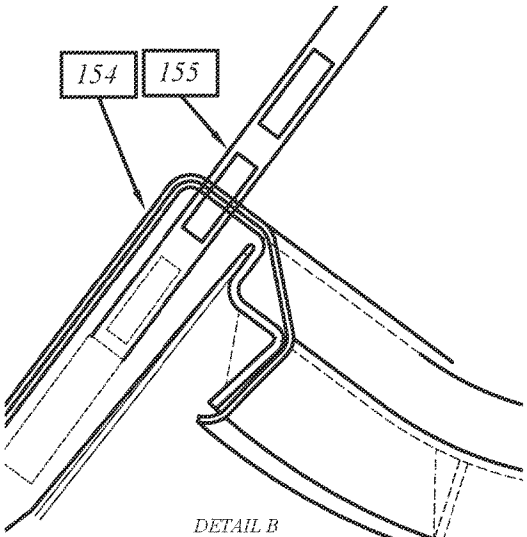
FIG. 22*c* is a close-up view of a baffle in a non-compressed position.
Figure 22A:
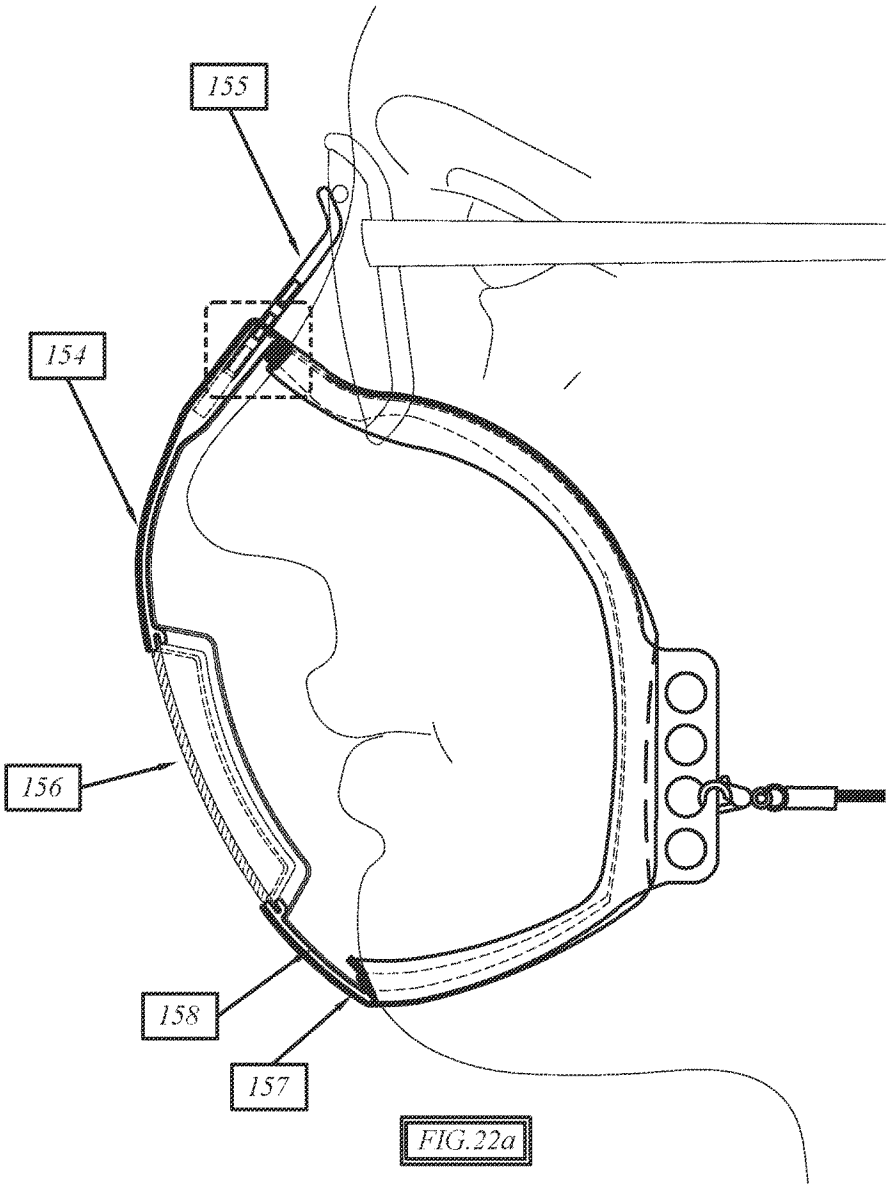
FIG. 22*a* is a side view of an embodiment of the present application having a lip-reading window.

Once the portion of the mask skeleton 130 is removed, a clear viewing window 156 is to be put in its place as show in FIG. 22*a*. The clear viewing window 156 may fit into a molded groove within the mask skeleton 130. Such a molded groove may be accessible at all times or may become accessible once the perforated portion of the mask skeleton 130 is removed. The molded groove retains the clear viewing window 156 thereby providing a seal to prevent the clear viewing window 156 from falling out of place.

As shown in FIGS. 22*b*-*c*, the baffle (as shown in FIG. 22*a*) is shown in a close up view in a compressed and non-compressed position. The baffle is preferably made of silicone and allows for the baffle, and by extension mask skeleton/frame, to be fitted to a specific user. The baffle resides, as shown in FIG. 22*a*, on the bridge of a nose of a user. The baffle has a natural state or position in which it wants to expand outwards and away from the main body of the mask and mask skeleton 130. As the baffle compresses when encountering a user's nose (or other feature) the uncompressed portions of the baffle will serve to form a seal around the remaining facial structures of the user. The baffle may further be disposed along additional portions of the mask skeleton/fame as opposed to solely being position where a user's nose would abut the mask.

Figure 23:
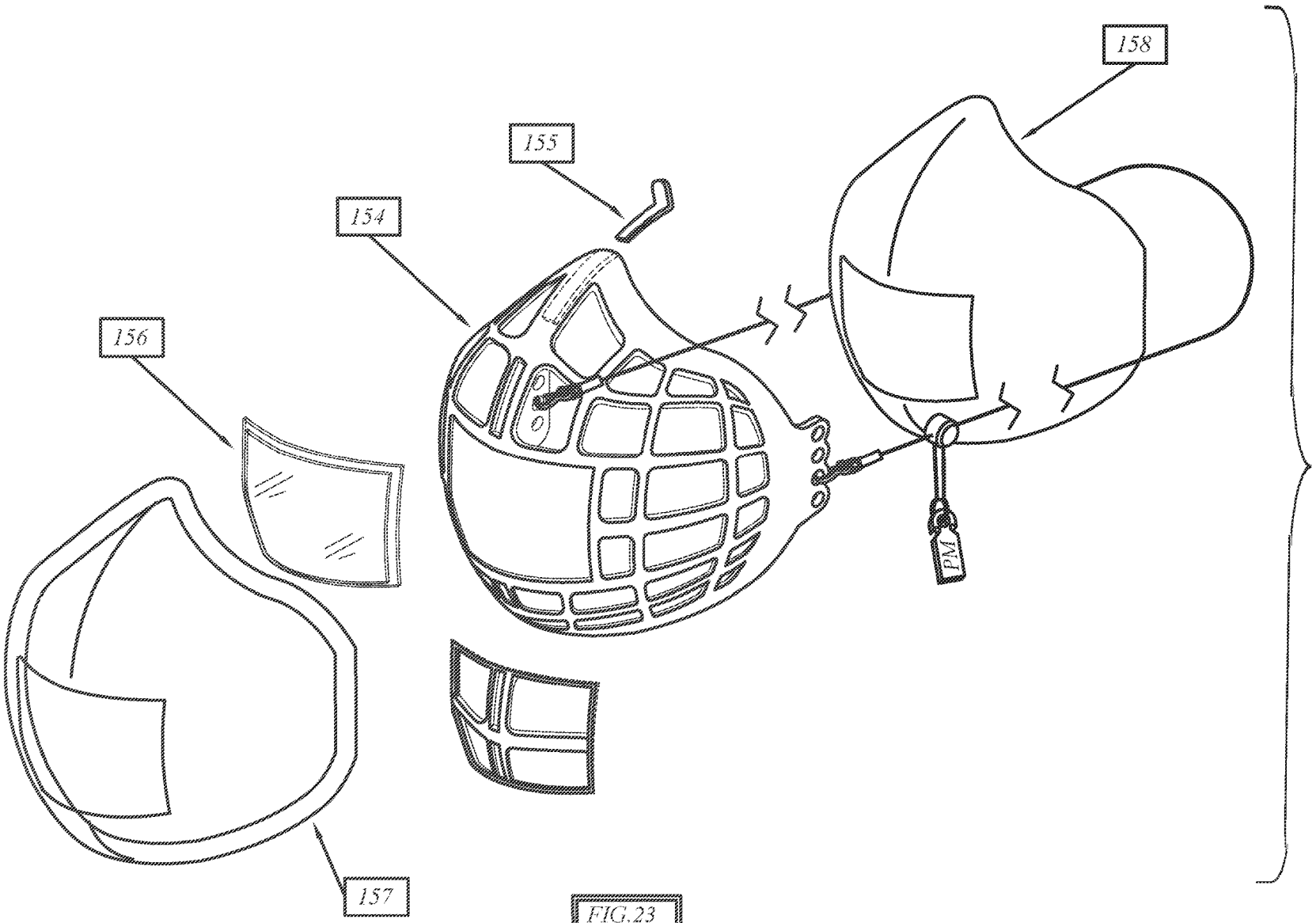
FIG. 23 is an exploded view of an embodiment of the present application having a lip-reading window.
Figure 24:
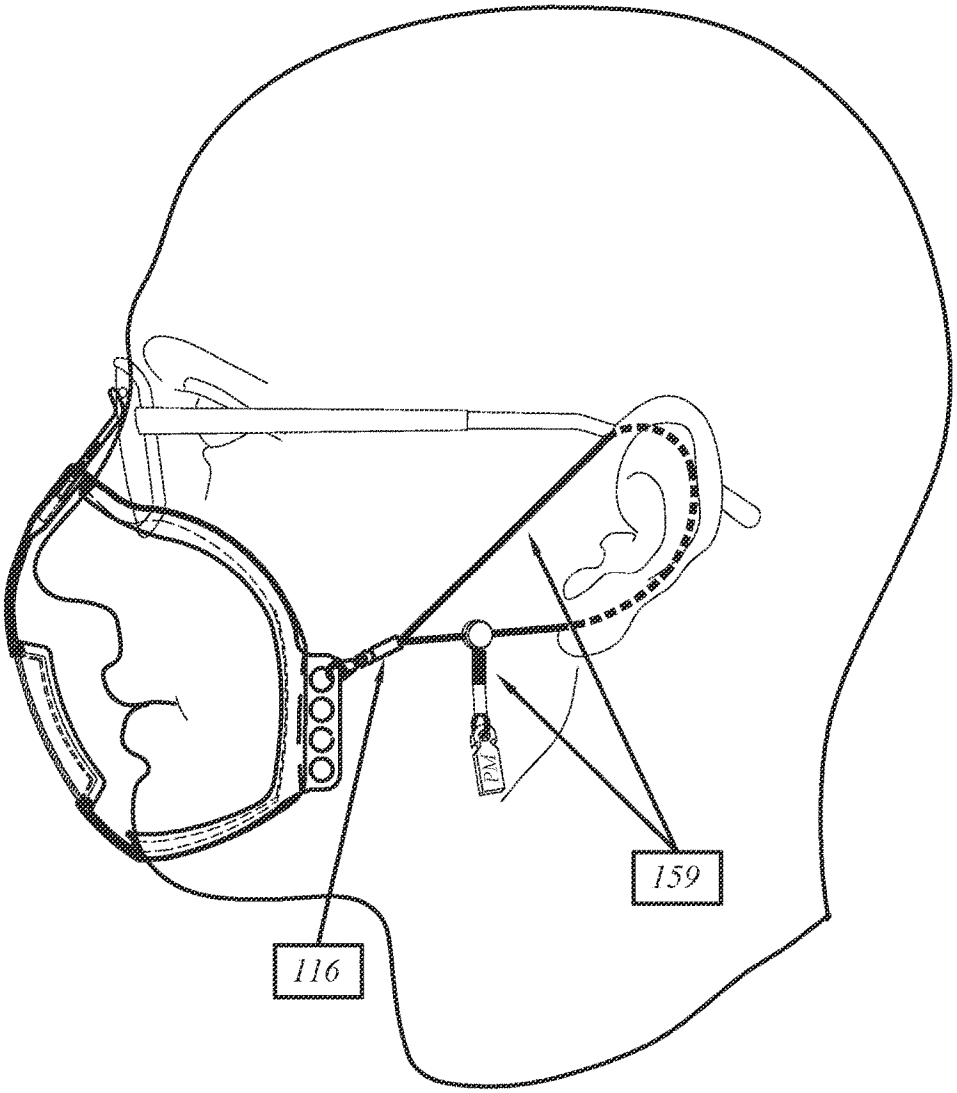
FIG. 24 is a side view of an embodiment of the present application having a lip-reading window attached to a face of a user.

In FIG. 23, there is an exploded view of the mask with a viewing window embodiment reminiscent of the exploded view in FIG. 14. Thus, there may be at least an outer layer 126, filter layer 128, mask skeleton 130, bracket 100, inner layer 134, fastening strap 116, inner layer eye glasses retainer 155, central aperture 138, and positioning strip 122. In some embodiments, there is simply a mask skeleton 130, a filter layer 128, and an outer layer 157. Here, the mask skeleton 130 has perforations to provide for the removal of a viewing window allowing for lip reading while wearing the mask system. The perforated portion of the mask skeleton 130 may be removed and the clear viewing window 156 inserted into the opening formed once the perforated portion of the mask skeleton has been removed. The clear viewing window 156 fits into the mask skeleton 130 as previously described herein. FIG. 24 shows such an embodiment from a side view with the unidirectional pull lanyard 159 extending over an ear of the user. The lanyard, while shown going over the ear, may or may not extend over the ear depending on user preferences. Any of the embodiments of lanyards and configurations thereof shown within this application may be used with the embodiment shown in FIG. 24.

The embodiments of the present invention as described herein have defined a facial covering system that may be used in a number of fashions and in a number of embodiments. In some instances, the bracket may be used and retrofit onto an existing protective and/or surgical mask to be worn by a user. In other embodiments, a dedicated mask system incorporating the mask skeleton, bracket, etc. can be utilized. The facial covering system is designed to provide flexibility in use of a mask and provide overall comfort to the user. The user of the facial covering system described herein can be virtually any user and may be even applicable to animals. If children or other smaller individuals desire to use the facial covering system, this is done by simply shrinking the proportions of the components in a way that provides the same fit as a normal or adult size covering system.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A facial covering system comprising:

a first bracket comprising a plurality of first apertures and a second bracket comprising a plurality of second apertures, wherein each of the plurality of first apertures extend through a thickness of the first bracket and each of the plurality of second apertures extend through a thickness of the second bracket, wherein the plurality of first apertures are linearly disposed on a first protruding portion of the first bracket and the plurality of second apertures are linearly disposed on a second protruding portion of the second bracket;

a mask body comprising at least one layer of a textile having a first pocket and a second pocket, the mask body further having a first edge and a second edge with a first central portion of the first bracket coupled to the first edge and a second central portion of the second bracket coupled to the second edge, wherein the first pocket is configured to cover a portion of a top surface and a portion of a bottom surface of the first bracket and a second pocket is configured to cover a portion of a top surface and a portion of a bottom surface of the second bracket;

a mask skeleton coupled to the mask body, wherein the mask skeleton has a lattice structure, and wherein the mask skeleton is coupled to the at least one layer of textile; and a fastening strap having a first end and a second end, the first end of the fastening strap being configured to couple to at least one of the plurality of first apertures of the first bracket and the second end of the fastening strap being configured to couple to at least one of the plurality of second apertures of the second bracket.

2. The system of claim 1 wherein both of the first bracket and the second bracket further comprises at least one hook.

3. The system of claim 2 wherein the at least one hook comprises a neck and a retainment bar.

4. The system of claim 1 further comprising an adjustable strip disposed along a top edge of the mask body.

5. The system of claim 1 further comprising at least one tab.

6. The system of claim 5 wherein the at least one tab is configured to couple to at least one hook and the mask body.

7. A facial covering system comprising:

a first bracket comprising a plurality of first apertures and a second bracket comprising a plurality of second apertures, wherein each of the plurality of first apertures extend through a thickness of the first bracket and each of the plurality of second apertures extend through a thickness of the second bracket, wherein the plurality of first apertures are linearly disposed along a width of a first protruding portion of the first bracket and the plurality of second apertures are linearly disposed along a width of a second protruding portion of the second bracket;

a mask body comprising at least one layer of a textile, the mask body further having a first edge and a second edge with a pocket located on each of the first end and the second edge, wherein a first central portion of the first bracket is coupled to the pocket of the first edge and a second central portion of the second bracket is coupled to the pocket of the second edge, wherein when coupled to the pocket each of the first protruding portion of the first bracket and the second protruding portion of the second bracket are exposed and a top surface of first bracket and the second bracket is otherwise covered by the pocket, and wherein the mask body has a sealing baffle disposed along a portion the mask body;

a mask skeleton coupled to the mask body, the mask skeleton having a lattice structure, wherein the mask skeleton is coupled to the at least one layer of textile of the mask body, and wherein a portion of the mask skeleton is removable via perforations in the mask skeleton;

a fastening strap having a first end and a second end, the first end of the fastening strap being configured to couple to at least one of the plurality of first apertures of the first bracket and the second end of the fastening strap being configured to couple to at least one of the plurality of second apertures of the second bracket.

8. The system of claim 7 wherein the mask body is formed from at least an outer layer, a filter layer, and an inner layer.

9. The system of claim 8 wherein the mask skeleton is disposed between the filter layer and the inner layer.

10. The system of claim 8 wherein the inner layer and outer layer has a centrally positioned aperture.

11. The system of claim 7 further comprising a viewing window configured to engage the mask skeleton when the portion thereof is removed.

12. The system of claim 7 wherein the mask skeleton further comprises a plurality of inwardly facing tabs along a top edge of the mask skeleton.

* * * * *